US007137438B2

(12) United States Patent
Nomura et al.

(10) Patent No.: US 7,137,438 B2
(45) Date of Patent: Nov. 21, 2006

(54) STORAGE DEVICE

(75) Inventors: Satoshi Nomura, Nagano (JP); Yuuichi Minamiyama, Nagano (JP); Ichiro Furihata, Nagano (JP); Kenji Kuno, Nagao (JP); Yasushi Iwata, Nagano (JP)

(73) Assignee: GAC Corporation (JP)

( * ) Notice: Subject to any disclaimer, the term of this patent is extended or adjusted under 35 U.S.C. 154(b) by 85 days.

(21) Appl. No.: 10/499,678

(22) PCT Filed: Dec. 27, 2002

(86) PCT No.: PCT/JP02/13773

§ 371 (c)(1),
(2), (4) Date: Oct. 14, 2004

(87) PCT Pub. No.: WO03/056260

PCT Pub. Date: Jul. 10, 2003

(65) Prior Publication Data

US 2005/0061758 A1 Mar. 24, 2005

(30) Foreign Application Priority Data

Dec. 27, 2001 (JP) ..... 2001-397744

(51) Int. Cl.
*A47F 3/04* (2006.01)

(52) U.S. Cl. ..... 165/64; 62/251; 62/255

(58) Field of Classification Search ..... 62/246–256; 165/61–66

See application file for complete search history.

(56) References Cited

U.S. PATENT DOCUMENTS 2,962,875 A * 12/1960 Barroero ..... 62/256
3,168,818 A * 2/1965 Weber ..... 62/256
3,289,432 A * 12/1966 Brennan et al. ..... 62/256
3,369,375 A * 2/1968 Gerweck et al. ..... 62/256
3,584,467 A * 6/1971 Barroero ..... 62/252
5,357,767 A * 10/1994 Roberts ..... 62/256
6,742,344 B1 * 6/2004 Vormedal ..... 62/89

FOREIGN PATENT DOCUMENTS

| | | |
|---|---|---|
| JP | 55-165468 | 12/1955 |
| JP | 62-57090 | 4/1987 |
| JP | 64-070678 | 3/1989 |
| JP | 3-124191 | 12/1991 |
| JP | 06-277123 | 10/1994 |
| JP | 07-54790 | 12/1995 |
| JP | 09-049678 | 2/1997 |

OTHER PUBLICATIONS

English Translation of International Preliminary Examination Report dated Mar. 2, 2004.
International Search Report, mailed Apr. 22, 2003.

* cited by examiner

*Primary Examiner*—William E. Tapolcai
(74) *Attorney, Agent, or Firm*—Blank Rome LLP

(57) ABSTRACT

A storage apparatus is provided that comprises a display case part with an inside thereof being dividable into a plurality of zones, a supply duct that is connected to supply openings for supplying conditioning air for controlling environmental conditions to the plurality of zones respectively, and an exhaust duct that is connected to exhaust openings for taking in air from the plurality of zones. In this storage apparatus, conditioning air such as cold air or hot air is circulated in the respective zones, and the environmental conditions can be adjusted efficiently in zone basis. Therefore, in a storage apparatus equipped with an open-type display case part, it is possible to dispense with an air curtain covering the entire open side, so that a storage apparatus with a high storage capacity is provided.

13 Claims, 20 Drawing Sheets

STORAGE DEVICE

TECHNICAL FIELD

The present invention relates to a storage apparatus that can display foods, canned drinks, and the like.

BACKGROUND ART

In convenience stores and supermarkets, perishable foods, canned drinks, and other items for sale are displayed or shown in showcases equipped with a refrigeration function. In many showcases, open cases are used where products can be easily put on display and replenished, and displayed products can be easily taken from the front side. One example of such a showcase is shown in FIG. 20. FIG. 20 is a vertical cross-sectional view schematically showing the construction of a storage apparatus 100. This storage apparatus 100 includes an open-type display case part 101 that aside from a front side 101*a* is covered with insulating walls so as to be approximately C-shaped in horizontal cross-section, with an inside thereof being a space or display room 104 in which products (goods, items for sale) 103 are displayed. The display chamber 104 is compartmentalized, by a plurality of display shelves 102 that are arranged in an up-down direction, into a plurality of zones 121 in which different types of food products can be displayed.

In this open-type storage apparatus 100, air C3 and cold air C2 are caused to flow from above the open space 101*a* on the front side of the display chamber 104 to form an air curtain 105 and thereby shut the display chamber 104 off from the outside. In addition, the cold air C2 on the inside chills the inside of the case 101, with zones for which a chilled effect is desired being further chilled by supplying cold air C1 from the rear surface or the like. The storage apparatus 100 is internally provided, below the case 101 or on the rear surface side, with a circulation fan 107 for forming the air curtain 105 and a heat exchanger 106 for generating the cold air C2 of the inner layer of the air curtain 105. The air C3 that forms the outer layer of the air curtain 105 is sent from the fan 107 to the top of the case 101 via an air duct 112, and is blown out downwards from a discharge opening 112*a* at the top of the case. The air is then sucked in from an intake opening 112*b* in the bottom of the case by the fan 107.

On the other hand, the cold air C2 that forms the inner layer of the air curtain 105 is chilled by the heat exchanger 106, is then sent to the top of the case by a cold air duct 111, is blown out downwards from a discharge opening 111*a*, and is then sucked in from an intake opening 111*b* in the bottom of the case. By doing so, the air and cold air flow from top to bottom on the open side 101*a* shut off the inside of the case 101 and also chills the inside of the case 101.

The storage apparatus 100 is also provided with a fluorescent lamp 116 for illuminating the products 103 as required and a defrost heater 115 required for defrosting a refrigerator and others for use as a usual open showcase By being provided with an air curtain, this type of storage apparatus 100 can thermally shut off the inside of the case 101, that is, the display chamber 104 from the outside while still being an open showcase. This means that foods that should preferably be chilled or cooled can be displayed in an open and accessible environment, and since it is possible to retain the freshness of groceries while attractively displaying the groceries and stimulating customers to buy them, such showcases are used in many stores. However, from the viewpoint of space efficiency, such showcases are not satisfactory storage apparatuses. For example, to form the air curtain 105 on the front side, it is not possible to position items in that particular space. This is because if items for sale were placed in the space used by the air curtain, the flow of air forming the air curtain would be obstructed, so that no air curtain would be formed and there would be a large drop in cooling efficiency. Accordingly, the effective width and/or the effective depth that can be used for chilling products inside the case become small relative to the outer dimensions of the case.

Also, to form an air curtain, it is necessary to blow air from the top of the case and to suck in air from the bottom of the case. Accordingly, it is necessary to provide a space for supply duct at the top of the case, so that the effective height that can be used for displaying products inside the case is reduced relative to the outer dimensions of the case.

If glass doors are used to close a display case in place of an air curtain, the cooling efficiency is high and the storage efficiency inside the display case may be increased. However, it becomes necessary to open and close the glass doors to take out the displayed products, which is troublesome and may discourage customers from making purchases. Also, as space is required to open and close the glass doors, the flows of customers are obstructed if sufficient passing space is not provided. In addition, glass doors that have been opened when replenishing or replacing products inside the display case obstruct the movement of customers. If, to solve these problems, a means that allows rear access to the display case is used, extra equipment and space to realize such means becomes necessary. Accordingly, if it were possible to solve the problems described above with open-type display cases that are caused by the air curtain, such cases could be favorably used as means for displaying products in a convenience store or the like.

While an air curtain can thermally shut off the inside of a case from the outside, the inside of the case is always placed in a chilled state. This means that it is not possible to simultaneously display products that should preferably be kept at room temperature or in a heated state. Accordingly, in convenience stores, it is common to see hotplates and/or heating showcases that display hot drinks and foods, such as in winter, being provided separately to open showcases. If the above problem could be overcome, open showcases could be used more widely.

For this reason, it is an object of the present invention to provide a storage apparatus, even if the storage apparatus is open type, having a large effective space for displaying products (goods and/or items for sale) and can display products with chilling and/or heating. It is a further object of the present invention to provide a storage apparatus that can simultaneously chill or cool products, keep products at room temperature, and also heat or warm products, if required.

DISCLOSURE OF THE INVENTION

In a conventional open-type storage apparatus, the air curtain is a major factor in preventing increases in space efficiency inside the case, but the temperature inside the case cannot be maintained without the air curtain. Accordingly, space is inevitably provided for the air curtain. In the present invention, the inside of the case is partitioned into small spaces and chilled or heated, so that it is possible to chill or heat products without using an air curtain that covers the entire case. Chilling methods that use an air curtain may effectively chill a relatively large space collectively and efficiently, but with the present invention, by partitioning the inside of the case into small spaces and chilling and/or heating, there is no need to control the temperature of a large space collectively and there is no need for an air curtain that covers the entire front of the case. Accordingly, with the present invention, it is possible to use space even more effectively inside an open-type display case.

In the present invention, an inside of a case is divided into a plurality of zones and supply openings or blow openings are provided for supplying conditioning air, such as cold air or hot air, for controlling the environmental conditions in each zone on a zone basis. Exhaust openings or intake openings for taking in or sucking in air from the zones are also provided so that the environment can be controlled in a unit of zone basis. The conditioning air is not limited to cold air and hot air, and includes, in addition to such types of air, humidified air and dried air for adjusting humidity, as well as other types of air. Accordingly, with the present invention, it is possible to set environments such as chilled, heated, humidified, or dried environments on a zone basis.

That is, the present invention provides a storage apparatus that includes a display case part with an inside thereof being divided or partitioned into a plurality of zones, a supply duct that is connected to supply openings for supplying conditioning air, for controlling environmental conditions, to the respective zones, and an exhaust duct that is connected to exhaust openings for taking or sucking in air from the zones. By supplying the conditioning air in the unit of zone basis, this storage apparatus can control the environments in different zones via the conditioning air respectively. By taking in air from the respective zones, it is possible to control the environments of zones independently even if in neighboring zones. Although a storage apparatus provided with a plurality of exhaust openings that can take in air from individual zones is preferable, a construction where a plurality of zones share one or a plurality of exhaust openings may be used. That is, in this storage apparatus, the exhaust opening may be disposed so as to be able to take in air from a plurality of zones, and by providing an exhaust opening that takes in air from a plurality of zones, the exhaust path can be simplified.

In the present storage apparatus, conditioning air such as cold air or hot air is circulated between supply opening (blow opening or blow port) and exhaust opening (intake opening or intake port) in each of the zone, that is relatively small space. Accordingly, it becomes easy to maintain the environmental conditions, such as the temperature, inside the zones, and it is possible to maintain the environmental conditions in zone basis even in an open showcase without shutting off the entire open side using an air curtain. Since the conditioning air is circulated in the unit of zone, it can be said that a condition resembling an air curtain is produced in the unit of zone basis.

In this storage apparatus, there is no need for an air curtain where air flows from top to bottom at the open front side, so that the space required for the air curtain is saved and used as display space. Accordingly the effective width of the storage apparatus is increased. Since a duct for an air curtain is not required at the top of the case, the effective height inside the case is also increased, so that the effective display space is further increased. In addition, since there is a reduction in the size of the units by which temperature adjustments, such as chilling and heating, or humidity adjustments are made, the cooling efficiency, heating efficiency, humidifying efficiency, and the like are improved, and it becomes possible to reach predetermined environmental conditions in a short time.

With the storage apparatus according to the present invention, it is possible to control the environments on a zone basis, so that in a single case, it is possible to chill, heat, maintain normal temperature, humidify, and dry on a zone basis. This means that it is possible to divide a single storage apparatus into a plurality of zones and display chilled products, normal temperature products, and/or heated products, so that the space inside a shop can be used effectively. Although it is possible to set in advance whether each zone will be used for chilled products, normal temperature products, or heated products, by providing supply dampers that open and close the supply openings and exhaust dampers that open and close the exhaust openings, it is possible to freely set the conditions in each zone in accordance with the usage environment.

In a storage apparatus where separators such as display shelves are attached inside the case to divide the case into zones, it is possible to provide, in a display shelf used as a separator, an internal duct for being connected to a supply opening and blow holes that are connected to the internal duct. The separators are not limited to display shelves that display items and compartmentalize the case in the up-down direction, and walls and the like that compartmentalize the case in the left-right direction are also included, with the premise being that such separators extend along the zones. Accordingly, by including ducts inside the separators or having ducts extend along the separators, it is possible to dispose intake holes or blow holes at appropriate positions along the zones. This means that it becomes possible to adjust the temperature of respective zones more efficiently.

In particular, the display shelves support the products by themselves, so that if blow holes that blow out the conditioning air are provided on the display shelves, the conditioning air simply sets an environment of the space where the products are placed along each of the display shelves. This means that it is possible to set the environment in the space around the products at the desired conditions in a short time and the desired environmental conditions can be maintained with little conditioning air. Accordingly, it is possible to provide a storage apparatus in which a suitable environment for items for sale can be maintained at low cost. A storage apparatus that includes a plurality of display shelves that are disposed inside the display case part and can blow out conditioning air via the display shelves is a storage apparatus according to one of the most effective aspects of the present invention. In a storage apparatus where the conditioning air is taken in from the display shelves, a layer of conditioning air along the display shelves can be formed and the environment around the products is also effectively maintained.

It is easy to make the display shelves attachable and detachable, and there is the advantage that the zones in which products are displayed can be formed flexibly. Accordingly, by using display shelves than can be detachably attached to the inside of the display case part and making it possible to blow out and/or take in the conditioning air via a display shelf from the supply opening and/or exhaust opening when the display shelf has been attached, it is possible to provide a storage apparatus with a large storage capacity, in which displays of items can be flexibly arranged, and which can simultaneously chill and heat items effectively. Also, detachable display shelf that can blow out and/or take in the conditioning air is effective in flexibly constructing zones whose temperature can be controlled inside the storage apparatus according to the present invention.

By providing the display shelf with a plurality of blow holes that blow out the conditioning air upwards and/or downwards, it is possible to easily supply the conditioning air to spaces or zones that are partitioned by the display shelves. Since products that are chilled, heated or humidified are arranged on the display shelves respectively, the conditioning air can be supplied directly onto the products or in a close vicinity of the products. This means that efficiency with which the environment of the products is adjusted is considerably improved.

To adjust the desired environmental conditions of a zone, it may be one of important factors that circulate and exhaust the conditioning air blown out into the zone from the blow holes of separators, such as the display shelves, approximately uniformly. When blow holes have been provided on the display shelves or the separators, to circulate the conditioning air as uniformly as possible in the zones, it is preferable to provide the display case part with intake regions that extend in the width direction of the display shelves or the separators and have approximately the same width as the width of the display shelves or the separators, the intake regions being connected to the exhaust duct. An exhaust opening in the form of a continuous slit may be formed in the intake region, and in view of the strength, a plurality of non-continuous exhaust openings can also be formed.

It is preferable that the display shelf comprises a first internal duct that can connect to a supply opening, blow holes that are connected to the first internal duct, a second internal duct that can connect to the exhaust opening, and intake holes that are connected to the second internal duct. With detachable display shelf, the second internal duct (the exhaust duct) may be formed when the display shelf is attached to the display case part.

If the display case part of the storage apparatus according to the present invention is an open type where displayed products can be taken from the front side, it is preferable to dispose the supply duct and the exhaust duct for supplying and exhausting the conditioning air to the respective zones away from the front side. Although it is possible to arrange these ducts on the side surfaces of the case, the zones are normally aligned along the rear surface of the case, so that it is preferable to dispose the ducts on the rear surface side of the case. It is possible to supply a conditioning air for controlling one of a plurality of environmental conditions from a single duct. It is also possible to provide a plurality of supply ducts for supplying conditioning air for controlling different environmental conditions. For example, it is possible to switch one supply duct between supplying cold air for chilling and supplying hot air for heating, or to provide a supply duct (first supply duct) for chilling and a supply duct (second supply duct) for heating. If first and second supply ducts is applied, by providing a first supply duct connected to a plurality of first supply openings that supply cold air to the respective zones and a second supply duct connected to a plurality of second supply openings that supply hot air to the respective zones, it is possible to easily supply different types of conditioning air to the respective zones.

With the storage apparatus according to the present invention, there is no need for an air curtain that covers the entire front side of an open-type display case, so that a roof duct that blows out a large amount of air for forming the air curtain from the front at the top of the case also becomes unnecessary. Accordingly, the ducts conventionally disposed along the roof of a display case to supply a large amount of air are unnecessary, and a roof part or roof plate of the display case can be formed of a transparent member such as glass or an acrylic material. This means that products (chilled items, normal temperature items, heated items) stored or displayed in each zone in the display case, and in particular in the uppermost zone that is closest to the roof become easier to see. By increasing the visual appeal of products to customers and making it easier for customers to pick up the products, it is possible to encourage customers to make purchases, thereby increasing the promotional effectiveness of the showcase In a construction where ducts are disposed at the top of the case, even if the roof part of the case is transparent, light will be blocked by the ducts and the areas inside the zones are dark. Therefore, conventionally, the insides of the zones inevitably have to be illuminated using a fluorescent lamp or the like to make the displayed products easy to see. In this invention, ducts are omitted from the roof part of the case part and the roof part becomes made transparent, it is possible to sufficiently illuminate the products inside the storage apparatus using the external lighting in the room where the storage apparatus is set up, so that the lighting means can be omitted from the storage apparatus. Or the load (power) of the lighting apparatus is reduced. In addition, the power required to overcome the heat generated by the lighting can be reduced. By doing so, it is possible to realize a compact storage apparatus with low power consumption.

When the environmental conditions are adjusted in the unit of zone with the display shelves disposed in the up-down direction as separators, there will be no display shelf positioned above the uppermost zone. It is preferable to provide roof blow holes that supply the conditioning air along the roof part of the display case part and for a front of the roof part to be a guide that forms a downward airflow at the opening in the display case part. By doing so, it becomes possible to form an air curtain in the uppermost zone. In addition, since the roof part often sticks out beyond the front ends of the display shelves, it is possible to create airflow like the air curtain in front of the front end of the display shelves, so that the showcase can be made even less susceptible to outside effects. By leading the conditioning air forwards at an angle using the guide, airflows directed towards the front is created against zones formed by the uppermost display shelf and lower display shelves, so that the showcase may becomes less susceptible to outside effects.

If the display shelf is detachable, it is preferable to provide a damper control means that can open and close a supply damper and an exhaust damper for each corresponding zone when the display shelf is attached. By merely attaching a display shelf, it is possible to form a new zone whose temperature can be controlled by controlling the blown amount and intake amount via appropriate open angles of the supply damper and the exhaust damper. When there are two systems of supply ducts for heating and chilling, it is preferable to provide dampers for the respective supply ducts, that is, first and second supply dampers that open and close the supply openings of the respective supply ducts and exhaust damper that open and close the exhaust opening of the exhaust duct. In addition, it is preferable that the display shelf or separator includes control means for controlling the respective dampers.

To appropriately set the conditions of the conditioning air supplied to the zones using a recycling system, it is preferable to provide an air duct that supplies air from the exhaust duct to the supply duct for arranging therein a refrigeration apparatus and a heating apparatus. By providing a switching means for switchably operating these apparatuses, it is possible to easily switch the conditioning air that flows in the supply duct from hot air to cold air or from cold air to hot air. Heating apparatus and cooling apparatus can be arranged in parallel in the air duct, but it is preferable to arrange these apparatuses in series for making the air duct compact and reducing the overall size of the storage apparatus. In addition, the heating apparatus should preferably be disposed downstream of the refrigeration apparatus so that the refrigerant is not heated. When a fan for pressurizing the air is provided, to suppress the heat load to the fan motor, the fan should preferably be disposed upstream of the heating apparatus.

In the storage apparatus according to the present invention, it is preferable for the amount of conditioning air supplied to and taken in from the zones to be almost balanced. Accordingly, it is preferable for the supply duct and the exhaust duct to be arranged so that a draft loss to a supply opening is approximately equal to a draft loss to the exhaust opening corresponding to the supply opening. By slightly increasing the supplied amount of the conditioning air and having part of the conditioning air leak out from the zones to the outside, effectively preventing zones from an affect of external air. It is preferable to take in fresh air by providing an air intake for taking in an external air upstream of the pressurizing fan disposed in the air duct. By disposing this external air intake at a position that can discharge a drain produced by the refrigeration apparatus, it is possible to have the external air intake double as a drain discharge outlet.

It is preferable to arrange the blow holes and intake holes provided on the display shelves or on the display case part so that the amount of conditioning air blown out into the respective zones is more than the amount of air taken in. However, if the difference in the amount of air blown out and the amount of air taken in is too large, not only there is no significant effect but also the power is merely wasted in chilling or heating the fresh air. It is preferable for the difference between the amount of air blown out and the amount of air taken in to be around 10% or less.

For a display shelf that blows out the conditioning air, some of the plurality of blow holes provided thereon should preferably be front end blow holes that blow out conditioning air upwards and/or downwards from the periphery of the front end of the display shelf. The front end of the display shelf is the part closest to the external air, and by blowing out the conditioning air from such part, it is possible to create a sufficient flow of the conditioning air at the open part of the zones, that is, at the boundary with the external air. Accordingly, in an open-showcase type display case, it is possible to form air curtains or a similar state in respective zones partitioned by the display shelves. This means that even if there is no air curtain covering the entire front side of the case, it is still possible to stably maintain the desired environmental conditions for the inside of the display case part, and in the storage apparatus according to the present invention that uses display shelves, the environments on the inside can be stably maintained at the desired conditions in zone basis.

It is effective to use display shelf where at least part of the plurality of blow holes are first front blow holes that blow out the conditioning air upwards from the vicinity of the front end of the display shelf and second front blow holes that blow out the conditioning air downwards from the vicinity of the front end of the display shelf. By doing so, it is possible to simply and more reliably form air curtains in zone by zone or the unit of zone. Accordingly, the penetration of external air into the zones can be suppressed more effectively, so that the amount of power required to reach the desired environmental conditions and to maintain such state becomes further reduced.

It is also preferable to blow out the conditioning air from the front blow holes forward at an angle. When the conditioning air is blown out from the front ends of the display shelves, by blowing out the conditioning air from in front of the products on display at the front end of the display shelves, it is possible to reliably cover all of the products including the products arranged at the front end with the conditioning air. In particular, the products displayed at the front end of the display shelves are the products that are easiest for customers to pick up, so that it is important to keep these products in a suitable state for the products so that there is no adverse effect on sales.

For display shelves provided with front blow holes, when cold air is supplied to the display shelves as the conditioning air, the difference in temperature with the external air makes it easy for dew or condensation to occur at the front end part of the display shelves. If droplets of condensation drip, this can have adverse effects, such as on the appearance of the products below. The front parts of the display shelves are also the most visible parts for customers. For this reason, it is preferable for such front parts to have an anti-dew-forming construction. Examples of the anti-dew-forming construction are a two-layer construction and an insulated construction.

It is preferable for display shelves that include internal ducts to have a construction that can be dismantled. This makes it possible to periodically clean the internal ducts and to keep the display shelves on which the products are displayed clean. With a display shelf that includes a shelf plate provided with a plurality of blow holes and a shelf main body including a recessed part whose upper part or lower part is an opening to above or below so as to become an internal duct for supplying the conditioning air to the plurality of blow holes, if the shelf plate is detachably attached to the recessed part of the shelf main body, it is possible to easily clean the internal duct by simply removing the shelf plate. With such display shelf, since the display shelf is assembled by placing a shelf plate made of stainless steel or the like, onto the shelf main body, that is, by laying the shelf plate onto the shelf main body by only its own weight, there is no need for fixings such as screws, so that the construction has a low cost and can be dismantled and inspected easily, so that cleaning becomes simple. In addition, by using a construction where an insulating material is attached to an outside or an inside of the recessed part inside the shelf main body, it is possible to prevent condensation from forming on the rear side of a display shelf and dripping. By detachably attaching the insulating material to the inside of the recessed part, it is possible to use the insulating material to adjust the form of the internal duct and possible to replace the insulating material. When the conditioning air blow out upwards from the display shelves, the blow holes are sometimes overlapped by the products displayed on the shelves, so that it is preferable to place a slatted-board or slatted board-like plate over the shelf plates. It is preferable for the uppermost layer of the display shelves to be lattice-like or slatted-board-like members. To make it possible for sliding a back product forwards when a front product displayed is taken from, it is preferable for the slatted-board-like member to be formed of a resin with a low friction coefficient.

BEST MODE FOR CARRYING OUT THE INVENTION

Figure 1:
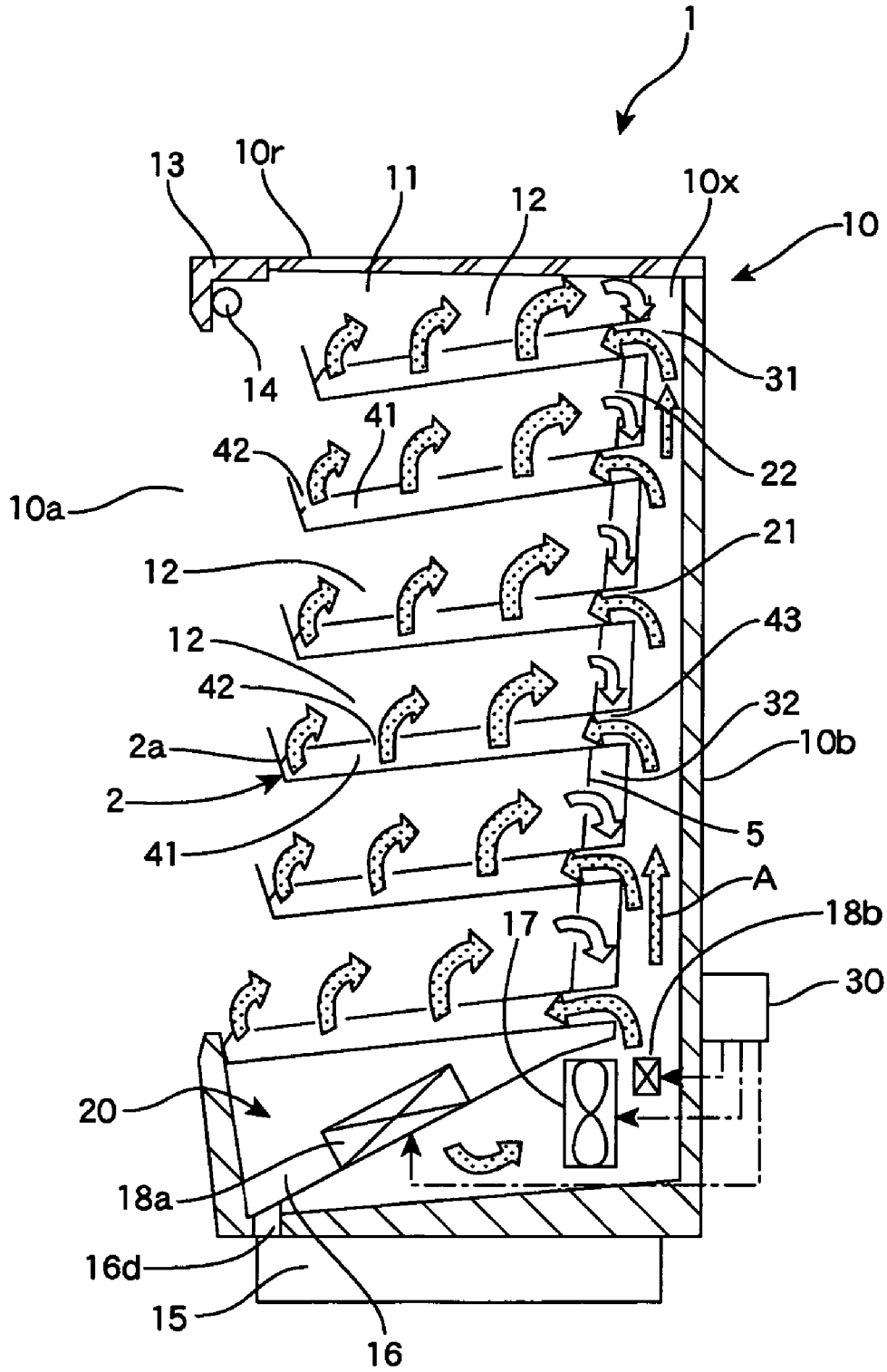
FIG. 1 is a view schematically showing a storage apparatus according to the present invention.
Figure 2:
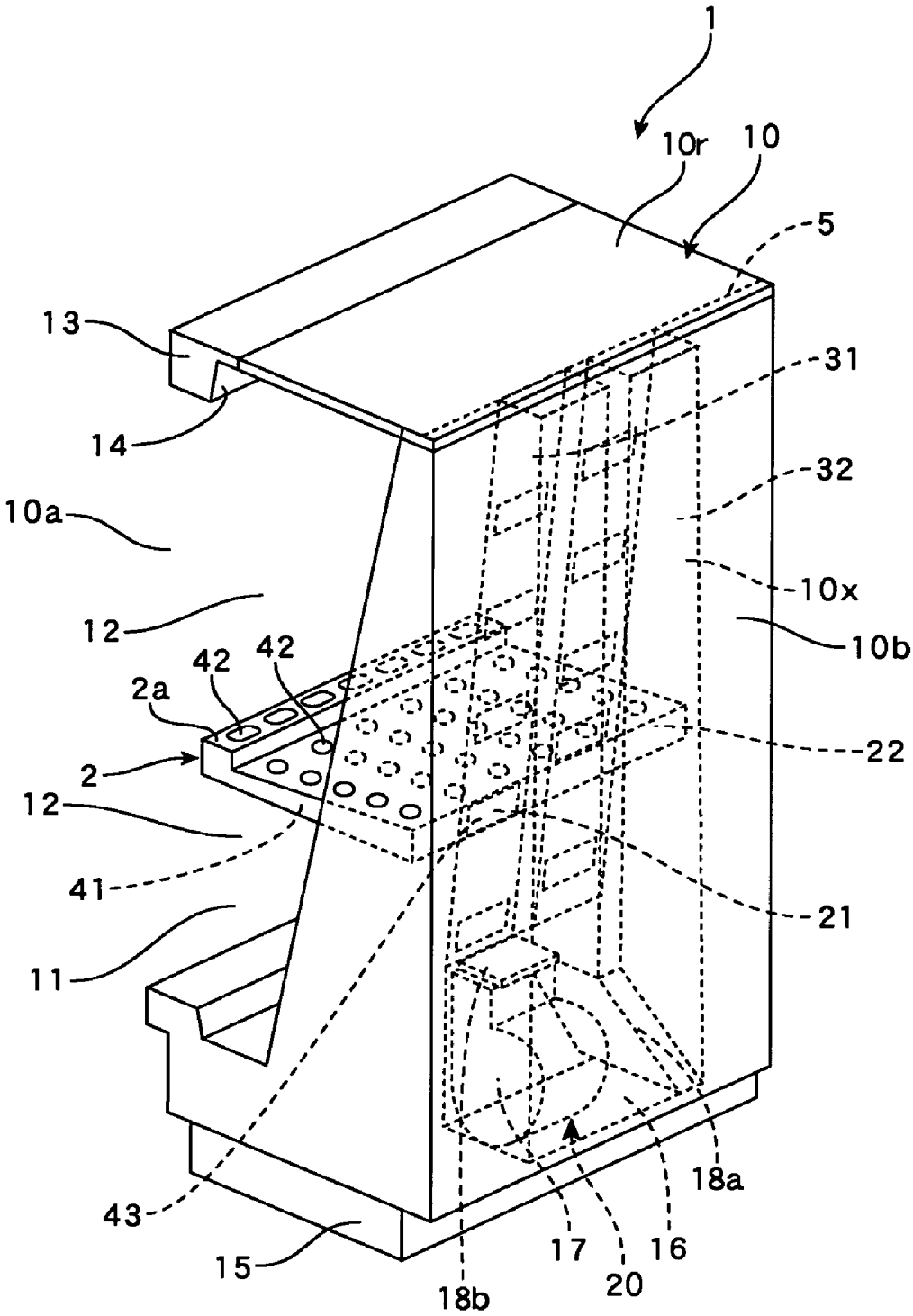
FIG. 2 is a perspective view schematically showing the structure of the storage apparatus of an embodiment.

The present invention will be described in more detail below with reference to the drawings. FIG. 1 is a vertical cross-sectional view schematically showing the construction of an embodiment of a storage apparatus according to the present invention. FIG. 2 is a perspective view schematically showing an inside construction of the storage apparatus 1 of the present embodiment. In FIG. 2, a state where one display shelf 2 has been set in an inside 11 of a case 10 is shown. The storage apparatus 1 includes a display case (a display case part) 10 that also serves as an insulated housing and a plurality of display shelves 2 that are attached to a display chamber 11 that is a display space inside the display case 10. The display space 11 is compartmentalized in the up-down direction by the display shelves 2 that are arranged in the up-down direction, thereby forming a plurality of zones 12 in which products can be arranged separately.

The display case 10 is a freestanding type that is set on the floor via a base 15, and is an "open-case" or "open-showcase" type where a front side 10*a* is open. Products are put on display or replenished from the front side and the displayed products can be easily taken from the front side. A light 14 is attached to a rear side of a cosmetic plate 13 in a front part of an upper part of the display case 10, so that the products displayed on the respective display shelves 2 can be appropriately illuminated. This means that customers can clearly see the products in an open and accessible environment, and can easily reach out and buy the products. In addition, a roof part 10*r* is made of a transparent acrylic material, so that the uppermost products that are difficult to illuminate with the internal light 14 can be illuminated by the interior lighting of the establishment. If the roof part 10*r* is higher than the customer's gaze when the case 10 is viewed by the customer, the outside will also be visible to the customer through the roof part 10*r*, making the display case 10 seem more open and accessible. On the other hand, if the roof part 10*r* is lower than the customer's gaze, the customer will be able to see products placed on the top level through the roof part 10*r*.

The inside of a rear wall 10*b* that is a rear surface side of the display case 10 forms a duct space 10*x*. In this duct space 10*x*, a supply duct (feeding duct) 31 with a plurality of blow openings (supply openings) 21 that can supply cold air or hot air to the respective zones 12 and an exhaust duct (return duct) 32 provided with a plurality of suction openings (exhaust openings) 22 that suck in air from the respective zones 12 are arranged so as to extend in the up-down direction along the rear wall 10*b*. The respective zones 12 that are formed by the display shelves 2 arranged in the up-down direction along the rear wall 10*b* are formed in parallel in the up-down direction along the rear wall 10*b*. This means that by extending the supply duct 31 and the exhaust duct 32 along the rear wall 10*b* on the rear surface of the display case 10, it is possible to supply conditioning air A (such as cold, air), whose temperature has been adjusted and is used for controlling environmental conditions to the respective compartmentalized zones 12 and to remove the air A from the respective zones 12. Accordingly, it is possible to efficiently maintain the temperatures of the respective zones 12, so that the products displayed on the respective display shelves 2 can be kept at the appropriate temperature. Here, the conditioning air can include both cold air and hot air, as well as air that has been adjusted so as to set a great variety of environmental conditions, such as humidified air or dried air for adjusting humidity, deodorized air, and scented air. Accordingly, by supplying the conditioning air A, it is possible to create and maintain an environment, such as a chilled, heated, humidified, or dried environment, on a zone basis.

In FIG. 1, the two ducts 31 and 32 are drawn as being parallel in the front-back direction, but as shown in FIG. 2, these ducts 31 and 32 are arranged in parallel in the width or horizontal direction. Accordingly, so long as it is possible to provide just a thin duct space 10*x* in the rear wall 10*b* of the display case 10, these ducts 31 and 32 can be adequately provided. In the supply duct 31, the plurality of supply openings or openings 21 are provided at suitable intervals that pass through a partition wall 5, which is a boundary between the duct space 10*x* and the display space 11, and supply cold air or a cold airflow into the display space 11. In the same way, in the exhaust duct 32, the plurality of exhaust openings or openings 22 that pass through the partition wall 5 and suck in air from the display space 11 are provided at suitable intervals. These supply openings 21 and exhaust openings 22 are arranged so as to blow out cold air and suck in exhaust air separately into and from the respective zones 12 formed when the largest number of display shelves 2 have been attached, that is, the smallest possible zones 12. Accordingly, in the storage apparatus 1, these supply openings 21 and exhaust openings 22 provided in the display case 10 can create and maintain chilled or heated environmental conditions in the unit of zone basis.

The bottom side of the display case 10 of the storage apparatus 1 is an equipment space 16. A fan 17 that sucks in air from the respective zones 12 via the exhaust duct 32 and supplies conditioning air to the respective zones 12 via the supply duct 31, a heat exchanger (refrigeration apparatus) 18*a* that adjusts the temperature of the conditioning air supplied to the respective zones, and a heater 18*b* for heating are arranged in this equipment space 16. Such equipment can supply a cold airflow and a hot airflow via the supply duct 31. The storage apparatus 1 uses a recycling system and the equipment space 16 functions as an air duct 20 that adjusts the temperature of air collected by the exhaust duct 32 and supplies the air to the supply duct 31. The refrigeration apparatus 18*a* and the heating apparatus 18*b* are disposed inside the air duct 20 and are controlled by a control apparatus 30 that is a switching means so that conditioning air of a desired temperature, such as cold air or hot air, can be supplied to the respective zones. In addition, it is possible to dispose appliances for adjusting other conditions, such as a humidifier, in the air duct 20.

The refrigeration apparatus 18*a* and the heating apparatus 18*b* are disposed in series. It is also possible to dispose the refrigeration apparatus 18*a* and the heating apparatus 18*b* in parallel, but a layout where these parts are arranged in series is suited to making the equipment space 16 or the entire apparatus more compact. Also, by disposing the heating apparatus 18*b* downstream of the refrigeration apparatus 18*a*, the refrigerant is not heated by the hot air generated by the heating apparatus 18*b*. In addition, the heating apparatus 18*b* is disposed so as to be downstream of the fan 17, so that the fan motor is protected from the heating load of the heating apparatus 18*b*.

An opening 16*d* that functions as a drain opening and an external air intake opening is provided in a base surface of the equipment space 16 that forms the air duct 20. The opening 16*d* is positioned upstream of the fan 17 so that external air is taken in as fresh air and is supplied together with the recycled air to the respective zones 12 after the temperature has been adjusted by the refrigeration apparatus 18*a*. Accordingly, the amount of air supplied to each zone is slightly larger than the amount of air sucked in, thereby creating a slightly pressurized state so that external air is prevented from penetrating the zones even more reliably. Although cold air and hot air can be supplied to the respective zones in the storage apparatus 1, an example case where a cold airflow is supplied to chill the respective zones 12 will be described below.

Figure 3:
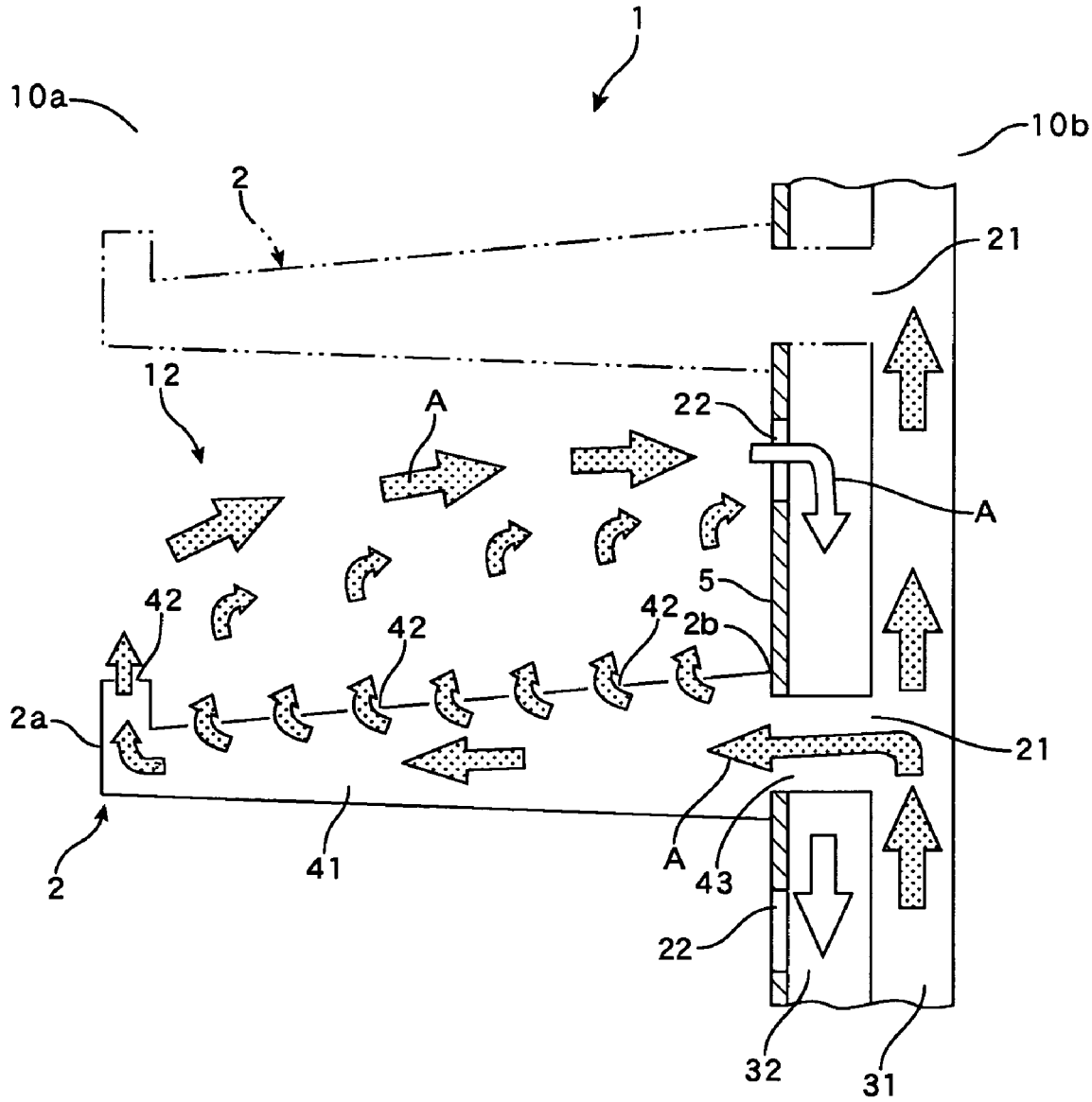
FIG. 3 is a view showing the flow of air.

FIG. 3 shows how the conditioning air A is blown out from a display shelf 2. The display shelves 2 of the present embodiment are respectively equipped with a connecting opening 43 that can connect the display shelf 2 to a supply opening 21, an internal duct 41 that is connected to this connecting opening 43, and blow holes 42 that are connected to the internal duct 41 and blow cold air upwards. Accordingly, when a display shelf 2 is attached to the partition wall 5 on the rear surface of the display space 11 by hooks or the like, cold air from the supply duct 31 is supplied via a supply opening 21 to the internal duct 41 of the display shelf 2 and is then blown upwards from the blow holes 42 of the display shelf 2. The cold air blown upwards is sucked in from an exhaust opening 22 positioned above the display shelf 2. Accordingly, a flow of the cold airflow "A" from the display shelf 2 to the exhaust opening 22 is formed in the zone 12 above the display shelf 2. This means that cold air A circulates in the zone 12 and can efficiently chill the zone 12 without dispersing to other zones or the front side 10*a* that is open. To make it easy for the cold air A to circulate in the zone 12 above the display shelf 2 without a short circuit occurring, each exhaust opening 22 is disposed immediately below an upper display shelf 2 that forms a higher zone. Accordingly, on the partition wall 5 of the display space 11, the supply openings 21 and the exhaust openings 22 are alternately formed in the height direction. If cold air A is blown out downwards from a display shelf 2, it is also possible to form a flow of cold air A in a zone 12 below a display shelf 2, and a storage apparatus of this kind of design is also included in the present invention.

On the display shelf 2, the plurality of blow holes 42 are disposed at approximately equal intervals across the display shelf 2 from the partition wall 5—side end 2*b* next to the rear wall 10*b* to a front end 2*a* on the front side 10*a*, and these blow holes 42 are designed so that the diameter becomes smaller from the front end 2*a* side of the display shelf 2 towards the rear end 2*b*. Accordingly, an adequate amount of the cold air A is blown out from the front ends 2*a* of the display shelf 2. This means that a sufficient amount of cold air A circulates from the front ends 2*a* of the display shelves 2 towards the partition wall 5 to chill the zone 12. The flow of the cold air A that is blown out of the blow holes 42 of the front end 2*a* of a display shelf 2 and reaches the exhaust opening 22 on the partition wall 5 crosses the zone 12 and so can chill the entire zone 12, and can also be thought of as partially functioning as an air curtain that shuts off the products arranged on the display shelf 2 of the zone 12 from external air. Accordingly, even if there is no large air curtain at the front side 10*a* of the display shelf 2, it is possible to control and maintain the temperature of the zone 12 approximately uniformly at a desired temperature. In addition, since cold air A is supplied directly to the zone 12, there is a large increase in the amount of cold air A that passes the zone 12 compared to the case where a large air curtain is provided only at the front side. This means that with the zone-based chilling method of the present invention, the intended temperature is reached in a much shorter time than a method that forms an air curtain.

Figure 20:
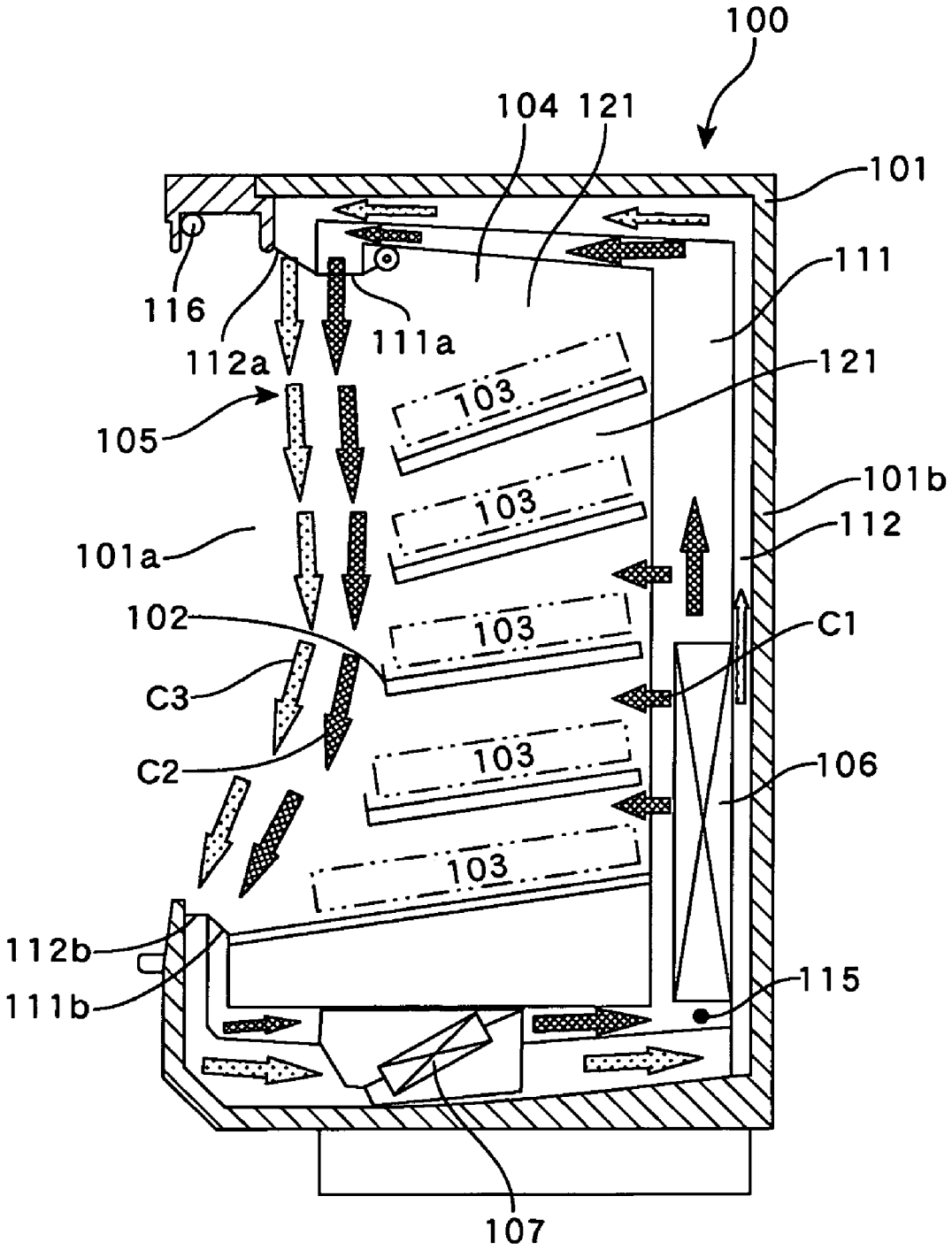
FIG. 20 is a view schematically showing a storage apparatus in which an air curtain is formed.

In this storage apparatus 1, it is possible, without forming an air curtain to cover the entire front side of the display case 10, to chill respective zones 12 to desired temperatures and to keep that temperature approximately uniform. Accordingly, the space for forming a large air curtain that covers the front side of the case can be used as space for displaying items for sale, so that the usage efficiency is improved in the width and/or depth directions of the display case 10. In addition, a large air curtain that covers the front side of the display case 10 is not required, so that it is no longer necessary to dispose ducts in the roof of the display case 10, and the roof space can also be used as space for displaying items. That is, the usage efficiency of the display case 10 in the height direction is also improved. Compared to the air curtain-type open showcase shown in FIG. 20, the open showcase according to the present embodiment has favorable space efficiency, so that an increase in display capacity of tens percentages and an increase in tens percentages in the number of storable or displayable products are expected.

Also, since it is not necessary to dispose ducts in the roof of the display case 10, by making the roof part 10*r* out of a transparent member such as glass or an acrylic material, the appearance of the respective zones of the display case 10, and in particular the uppermost zone that is closest to the roof can be made more open and accessible. Accordingly, the displayed products can have a stronger visual appeal to customers and since it is also easy for customers to pick up the products, customers are encouraged to make purchases, thereby increasing the promotional effectiveness of the showcase.

Also, by omitting the ducts from the roof part 10*r* of the display case 10 and making the roof part 10*r* transparent, it becomes possible to sufficiently illuminate the displayed products with the lighting provided in the room in which the storage apparatus 1 is set up. As a result, it is possible to omit a lighting means from the inside of the storage apparatus or to reduce the output of such means, so that a compact storage apparatus with low power consumption can be realized.

In the storage apparatus 1, by supplying conditioning air from a plurality of blow holes 42 on the display shelves 2, conditioning air is supplied from a plurality of positions along the space where products are displayed. This means that the desired environment can be achieved along the space containing the products in a short time and with a small amount of conditioning air. In addition, in the storage apparatus 1, the respective zones 12 are chilled with the cold air A independently, so that it is possible to change the set temperatures of respective zones 12 and to not chill the respective zones 12 individually. By supplying a hot airflow from the supply duct 31, it is also possible to heat the respective zones as described above. It is possible to control whether the supplying of the cold air A from the supply openings 21 and the taking in of air from the exhaust openings 22 are stopped using dampers 25 and 26 that are provided on the individual supply opening 21 and exhaust openings 22. In this storage apparatus 1, means that can operate the dampers 25 and 26 are provided on the display shelves 2 that are detachable.

Figure 4:
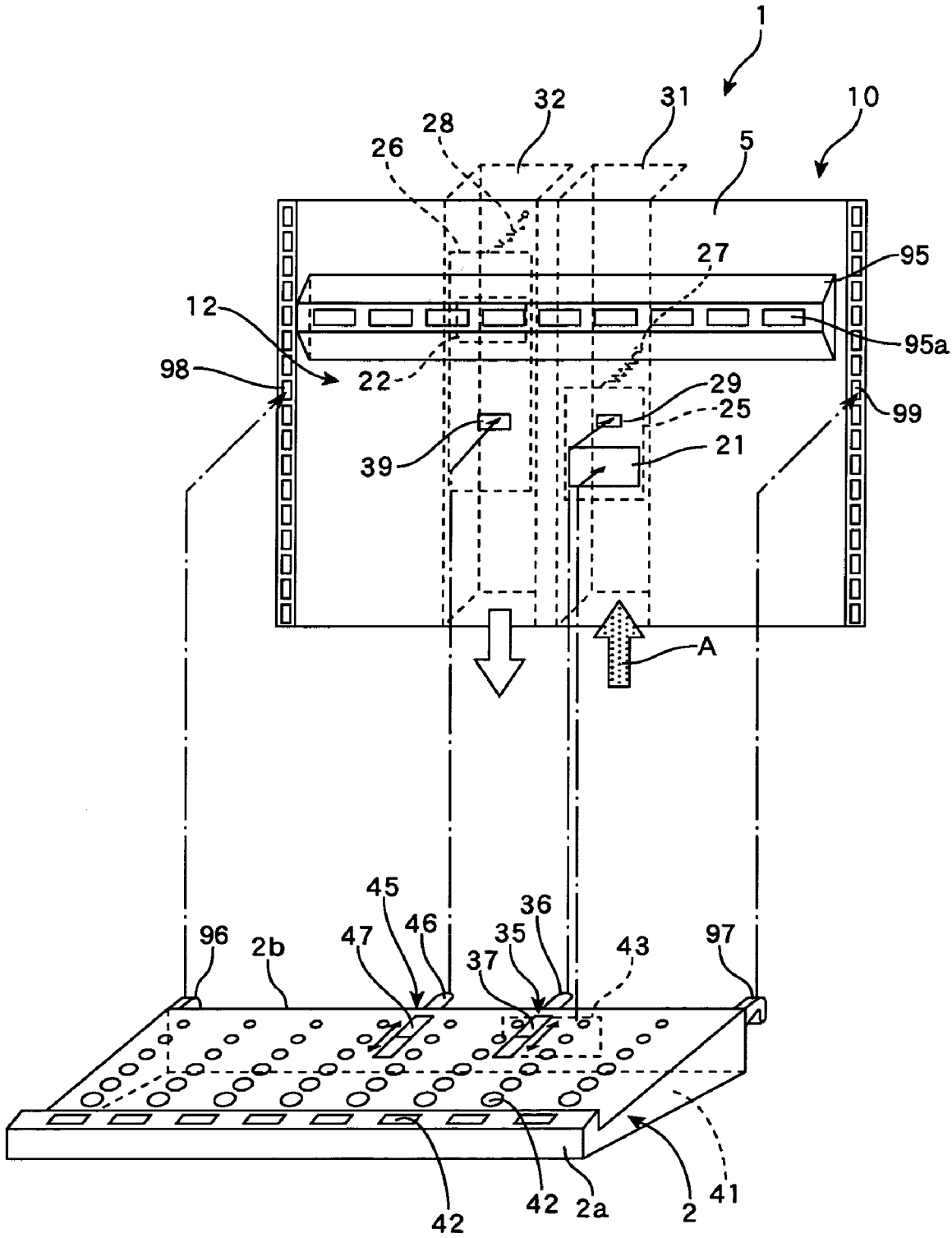
FIG. 4 is a view showing how the display shelves are attached.

FIG. 4 shows how a display shelf 2 is attached to the partition wall 5 on the rear wall of the display case 10. To make a display shelf 2 attachable and detachable for the partition wall 5, hooks 96 and 97 project backwards from both ends of a rear surface 2*b* of the display shelf 2 and are fitted into holes 98 and 99 provided in advance in the partition wall 5. By attaching a display shelf 2 to the partition wall 5 at a position where the connecting opening 43 on the rear surface 2*b* of the display shelf 2 faces a supply opening 21, the zone 12 above the display shelf 2 is set as a single chilled zone. The display shelf 2 is also provided with damper control apparatuses 35 and 45 that respectively control the supply damper 25 that opens and closes the supply opening 21 and the exhaust damper 26 that opens and closes the exhaust opening 22. Therefore, by simply attaching the display shelf 2 to the partition wall 5, it is possible to make the zone 12 above the display shelf 2 a zone whose temperature can be controlled independently.

Figure 5:
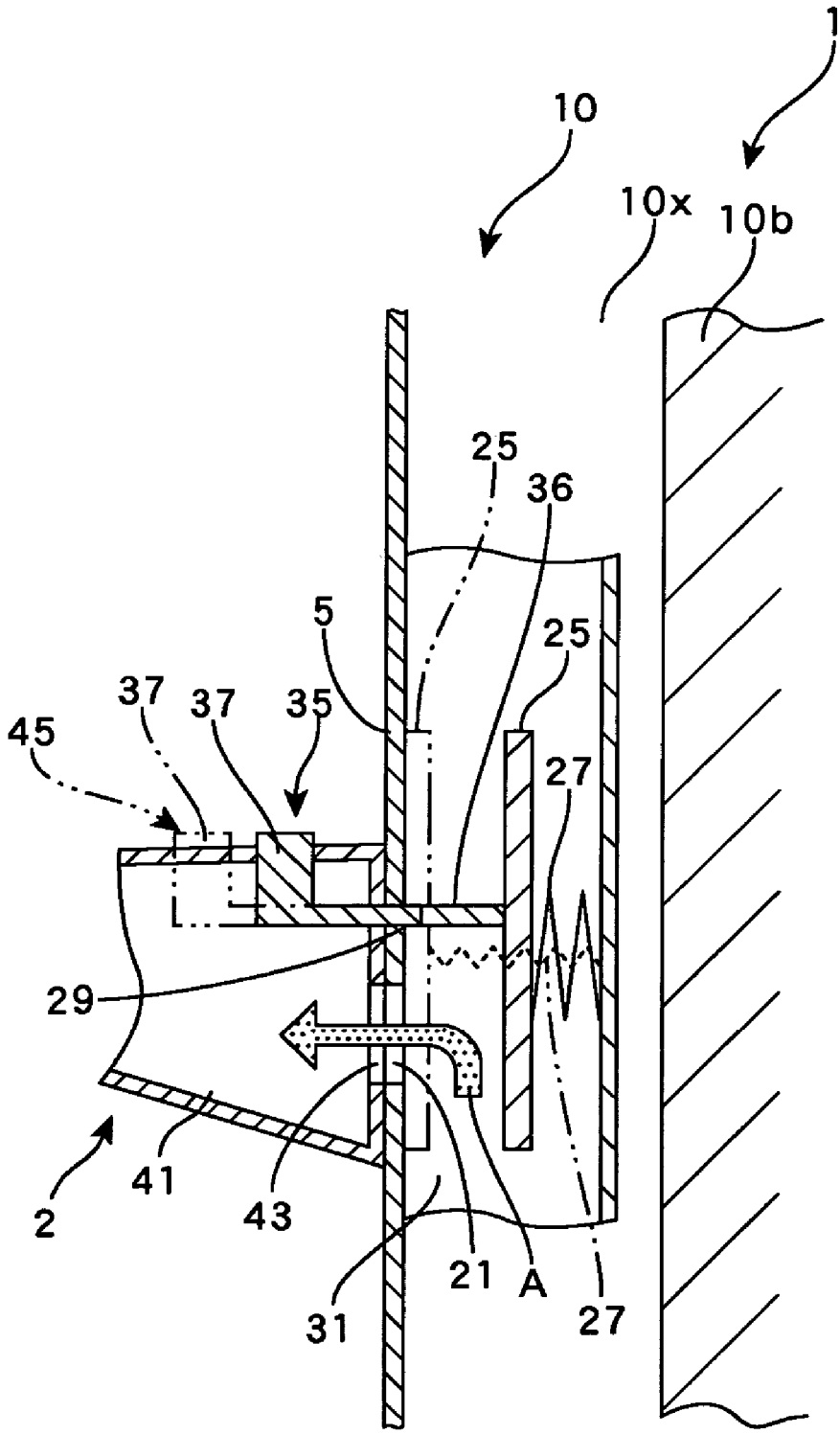
FIG. 5 is a view showing how a supply damper is operated by a damper control apparatus.

FIG. 5 is a cross-sectional view showing how a supply damper 25 is controlled. The control apparatus 35 is provided with a lever or rod 36 that can press a supply damper 25 via a hole 29 provided in the partition wall 5 and an operation knob 37 for operating the lever 36 from the front of the display shelf 2. By moving the operation knob 37 back and forth, the part that projects inside the duct extends and contracts. The supply damper 25 is pressed by a spring 27 from the inside of the supply duct 31 onto the supply opening 21, and in a state where the lever 36 is not pressed into the supply duct 31, the supply damper 25 covers the supply opening 21. Accordingly, the cold air A is not blown out from the supply opening 21 and the zone covered by this supply opening 21 is not chilled.

The control apparatus 45 is also provided with a lever 46 that can press an exhaust damper 26 via a hole 39 provided in the partition wall 5 and an operation knob 47 that can operate the lever 46 from the front of the display shelf 2. The construction of each exhaust damper 26 is the same as that of the supply damper 25 with each exhaust damper 26 being pressed by a spring 28 onto an exhaust opening 22 from the inside of the exhaust duct 32. Accordingly, if the lever 46 of the control apparatus 45 is not inserted inside the exhaust duct 32, the exhaust opening 22 is covered by the exhaust damper 26 and air is not taken in by the exhaust opening 22.

When a display shelf 2 is attached to the partition wall 5 and the operation knob 37 is moved, the lever 36 extends inside the supply duct 31 and presses the supply damper 25, thereby opening the supply opening 21 so that the cold air A is supplied via the display shelf 2 to the zone 12. This is also the case for the exhaust air, so that when the operation knob 47 of the control apparatus 45 is operated and the lever 46 extends, the exhaust opening 22 is opened so that a flow that circulates the cold air A in the zone 12 is formed and the zone 12 starts to be chilled.

In addition, in the storage apparatus 1 according to the present embodiment, as shown in FIG. 4, an intake duct 95 that extends in a horizontal direction in the partition wall 5 is provided at each exhaust openings 22. This intake duct 95 takes in cold air from the zone 12 via a plurality of holes 95*a* provided in a distributed manner in the horizontal direction, so that inside the zone 12, it is possible to form an even flow of cold air in the horizontal direction also, so that the zone 12 is chilled more evenly. If the intake duct 95 can be made sufficiently strong, the exhaust holes 95*a* that are non-continuously provided in FIG. 4 may be provided in the form of a continuous slit.

Figure 6A:
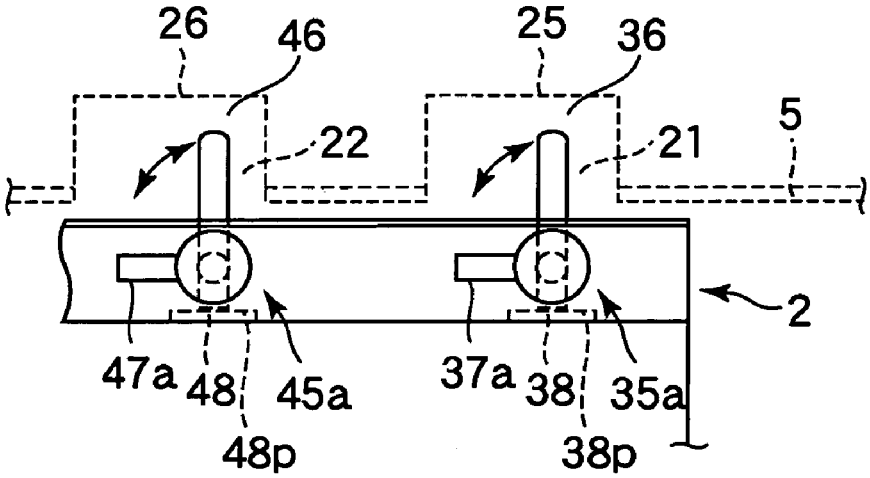
FIG. 6A is a plan view showing the construction of a damper control apparatus.
Figure 6B:
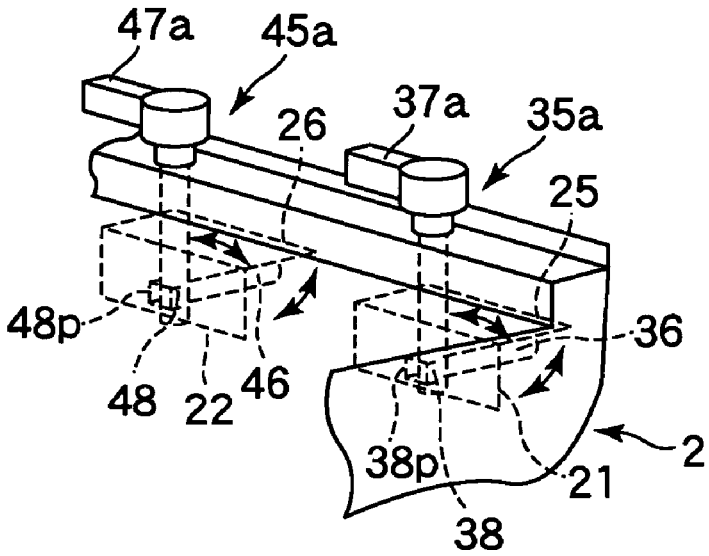
FIG. 6B is a perspective view of the damper control apparatus shown in FIG. 6A.
Figure 6C:
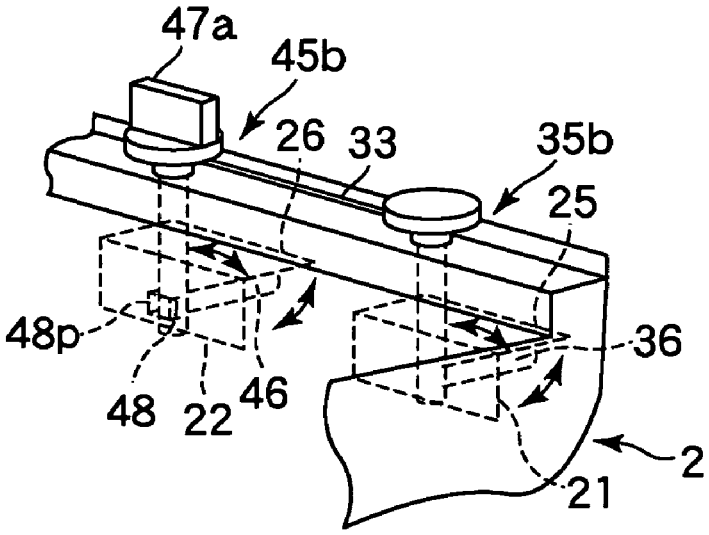
FIG. 6C is a perspective view showing another damper control apparatus.

FIGS. 6A to 6C show different damper control apparatuses. The damper control apparatuses 35*a* and 45*a* shown in FIGS. 6A and 6B rotate the levers or rods 36 and 46 to a direction to the supply opening 21 and the exhaust opening 22. By rotating the knobs (operation parts) 37*a* and 47*a* provided at the surface of each display shelf 2, the supply damper 25 and the exhaust damper 26 can be controlled via the levers 36 and 46. The supply damper 25 and the exhaust damper 26 may slide back and forth, or as shown in FIGS. 6A to 6C may rotate up and down (in the vertical direction). The supply damper 25 and the exhaust damper 26 may even slide left and right (in the horizontal direction), but since the display shelves 2 are not especially thick, the supply opening 21 and the exhaust opening 22 that should be long in the horizontal direction have to be covered by dampers 25 and 26 that are long in the horizontal direction, with it being preferable for such dampers 25 and 26 to rotate up and down to reduce the space occupied by the dampers.

Figure 15:
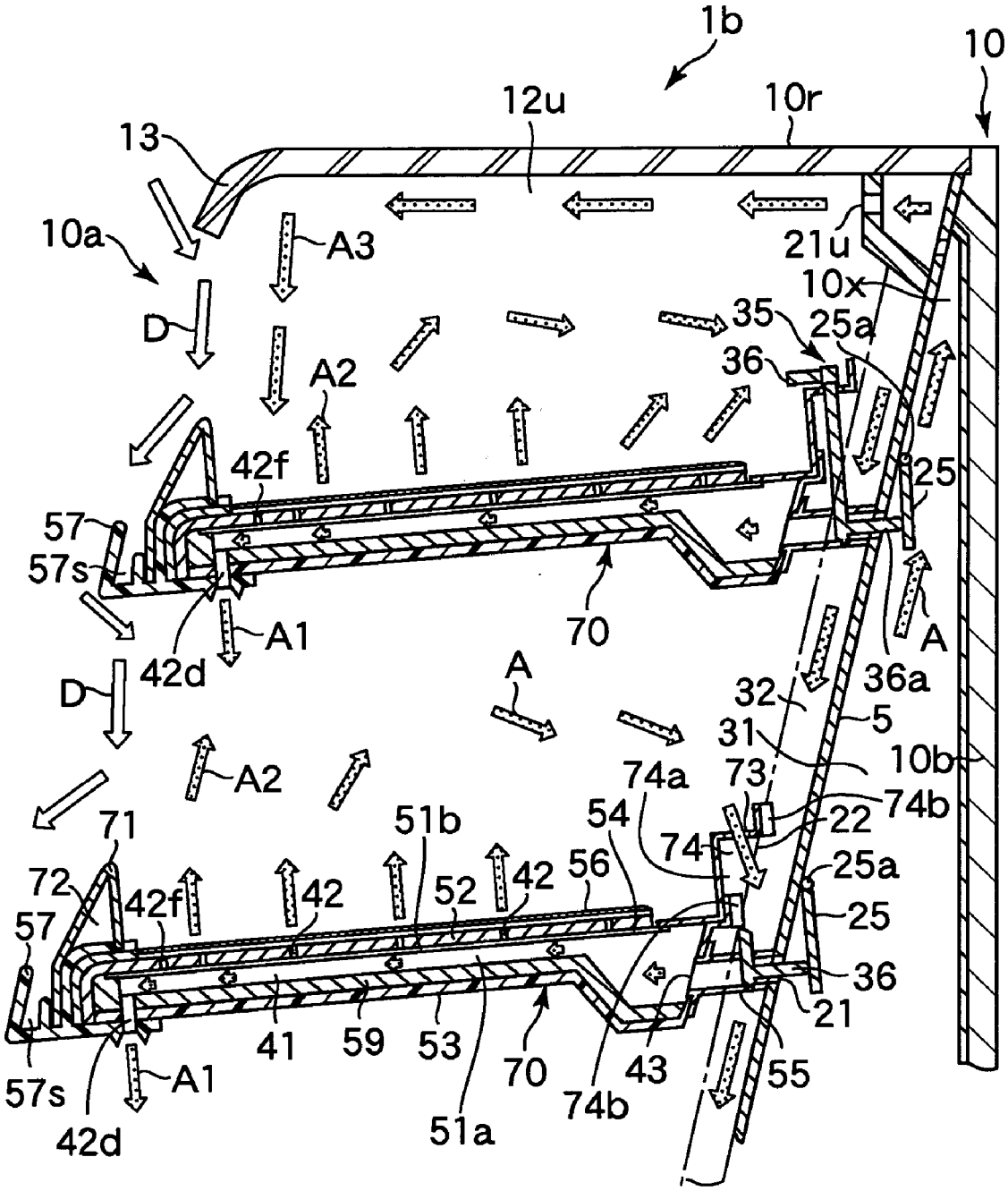
FIG. 15 is a cross-sectional view showing an enlargement of part of a storage apparatus to which other display shelves have been attached.

Rotary-type dampers are also shown in FIG. 15 that is described later. A supply damper 25 that rotates about a pivot 25*a* is advantageous in that it is easier to open and close than a push-down type damper. In many cases, the partition wall 5 is inclined so that the display shelves 2 are disposed in a stepped arrangement to make the products easy to see and easy to pick up. Accordingly, with push-down type dampers it is necessary to use a slightly complex construction of guides and the like to press down dampers parallel to the inclined partition wall 5. When rotary-type dampers are used, the dampers do not need to be operated in parallel, so that such dampers can be easily attached to an inclined partition wall 5.

The damper control apparatuses 35*a* and 45*a* can individually operate the supply damper 25 and the exhaust damper 26 via separate knobs 37*a* and 47*a*. To prevent the levers 36 and 46 of the damper control apparatuses 35*a* and 45*a* from being pushed back and the openings 21 and 22 closing, support mechanisms 38*p* and 48*p* for supporting opposite sides 38 and 48 to the levers 36 and 46 in the state where the dampers are pushed and thereby preventing the levers from falling are provided on the display shelf 2.

The damper control apparatuses 35*b* and 45*b* shown in FIG. 6C are connected by a connecting rod 33 so that when the operation part 47*a* is rotated, it is possible to have the two levers 36 and 46 simultaneously rotated. Accordingly, one of the damper control apparatuses 35*b* does not require an operation part and the two levers 36 and 46 can be operated by the operation knob 47*b* of the other damper control apparatus 45*b*. By doing so, the damper operation is simplified and a state where a zone 12 is not chilled due to the operator forgetting to open one of the dampers can be prevented. Since the two levers 36 and 46 move in a linked manner, it is sufficient to provide one end part 48 that extends from one of the levers 46 and contacts the support mechanism so as to prevent the levers from falling.

By attaching a display shelf 2 to the storage apparatus 1, the region above the display shelf 2 is set as a zone 12 whose temperature can be controlled. By operating the damper control apparatuses 35 and 45, it is possible to supply cold air to chill the zone 12 or not supply cold air and keep the zone 12 at normal temperature. By adjusting the open angle of the dampers 25 and 26 to control the amount of cold air A supplied to the zone 12, it is possible to freely set any state between mild chilling and strong chilling.

Figure 7:
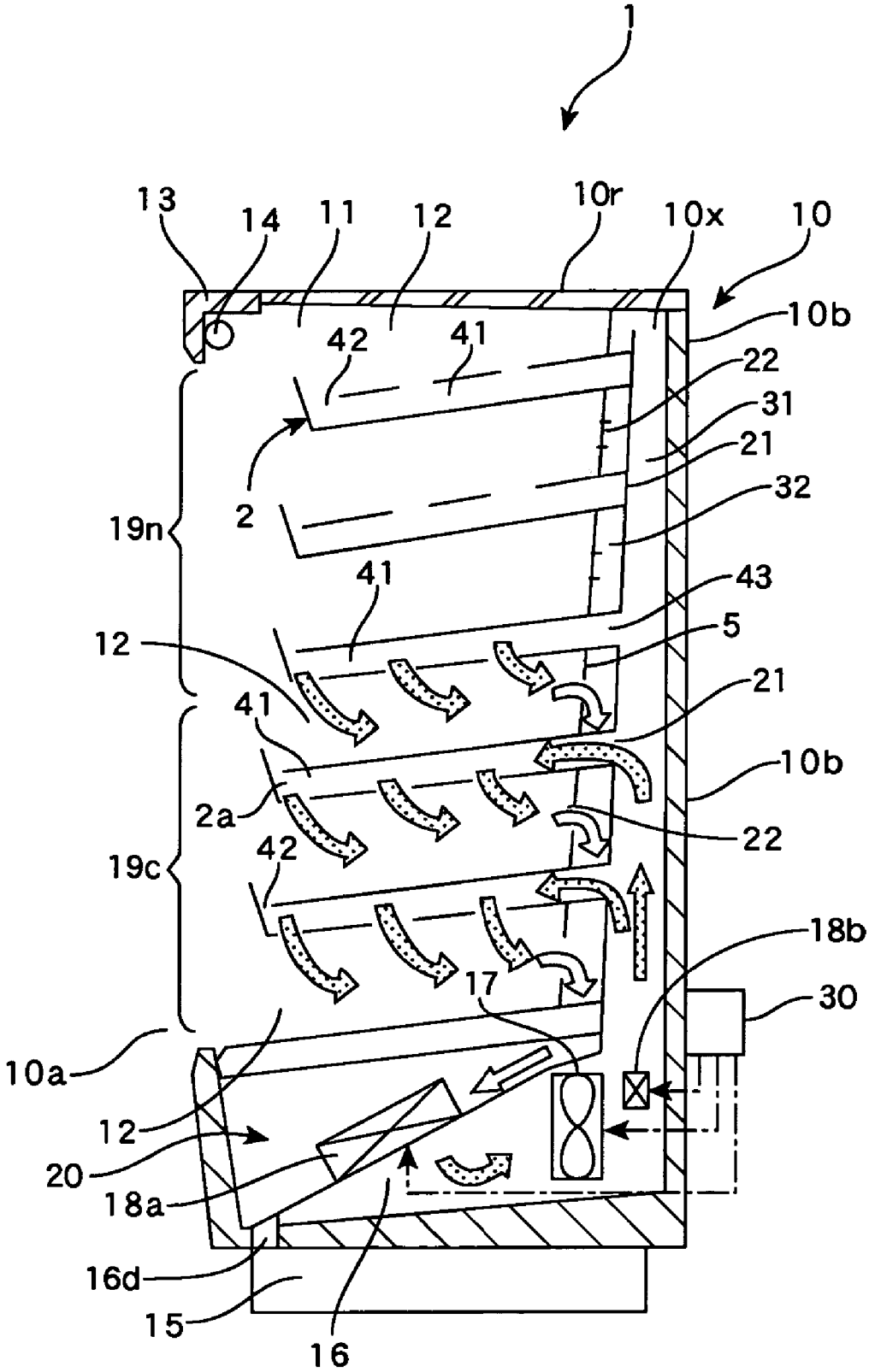
FIG. 7 is a view schematically showing a storage apparatus where a cold region and a normal temperature region are provided inside the case.

Accordingly, as shown in FIG. 7, it is possible to arrange the zones 12 in which the temperature are controlled to form a normal or room temperature regions 19*n* and zones 12 in which the temperature are controlled to form a chilled regions 19*c* in the display space 11 of a single storage apparatus 1 simultaneously. This means that the display space 11 of the storage apparatus 1 can be flexibly divided and used in accordance with the amount and types of items on sale. In the example shown in FIG. 7, cold air A is blown out from below the display shelves 2 and chilled zones 12 are formed below the display shelves 2.

Figure 8:
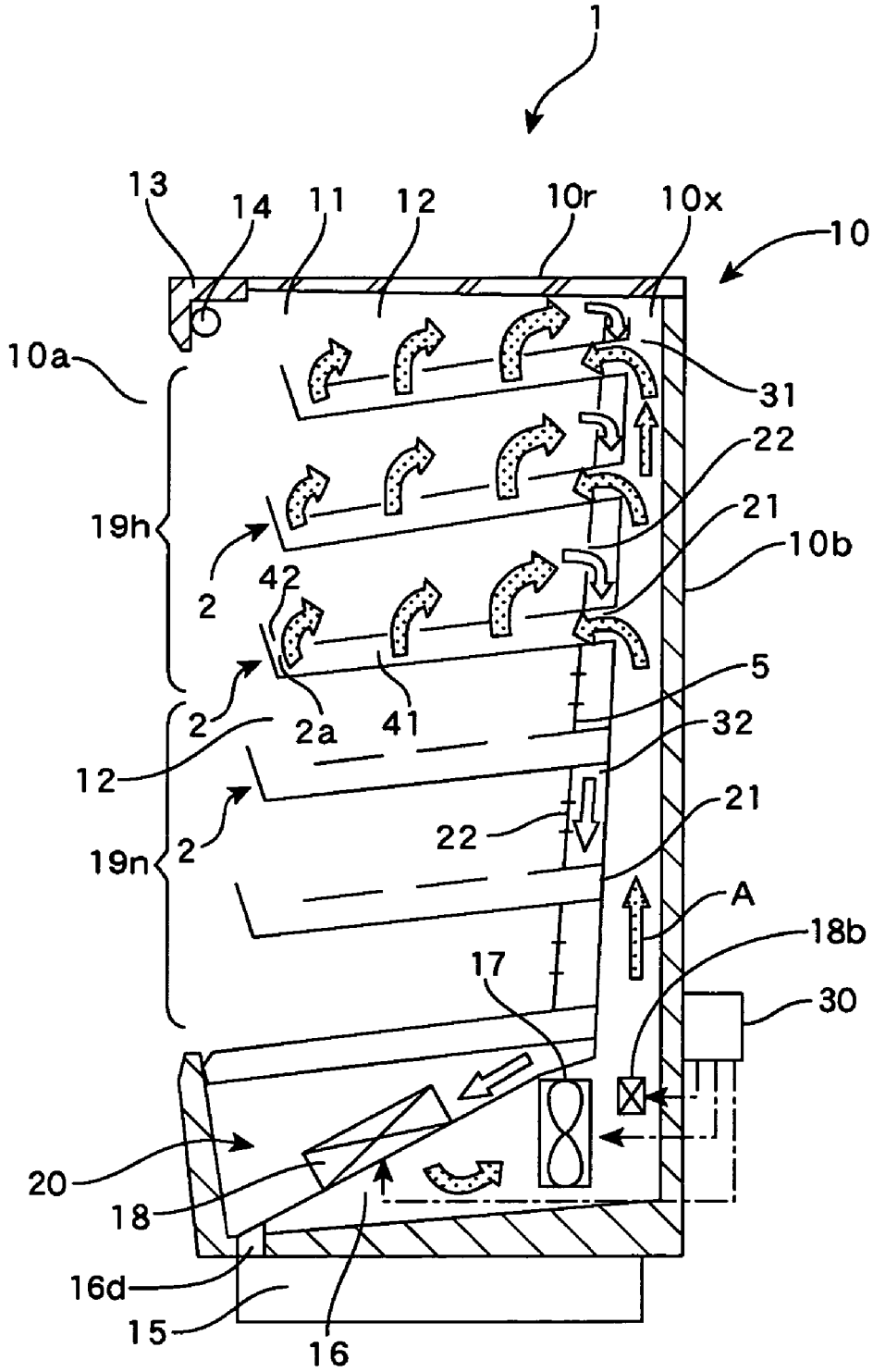
FIG. 8 is a view schematically showing a storage apparatus where a hot region and a normal temperature region are provided inside the case.

FIG. 8 schematically shows another storage apparatus. In this storage apparatus 1, a hot or warm airflow is supplied by the supply duct 31 so that zones in which the temperature is controlled are formed so as to produce a heated region in the display space 11. In this storage apparatus 1, the temperature is controlled so that a hot airflow A is supplied to the upper zones 12 that are separated by the display shelves 2 to produce a heated region 19*h*. The hot airflow A is not supplied to the zones 12 that are separated by the display shelves 2 at the bottom of the storage apparatus 1, so that these zones 12 form room temperature regions 19*n*. Also, by attaching the display shelves 2 that separate the zones 12 to the exhaust openings 22, it is possible to use the holes 42 and ducts 41 provided in the display shelves 2 as exhaust holes and ducts. In this case, as described above, by providing holes 42 for sucking in air at the front ends 2*a* of the display shelves 2, it is possible to circulate a cold airflow or hot airflow in each entire zone so that it is possible to chill or heat each zone with sufficient efficiency even in an open showcase.

Figure 9:
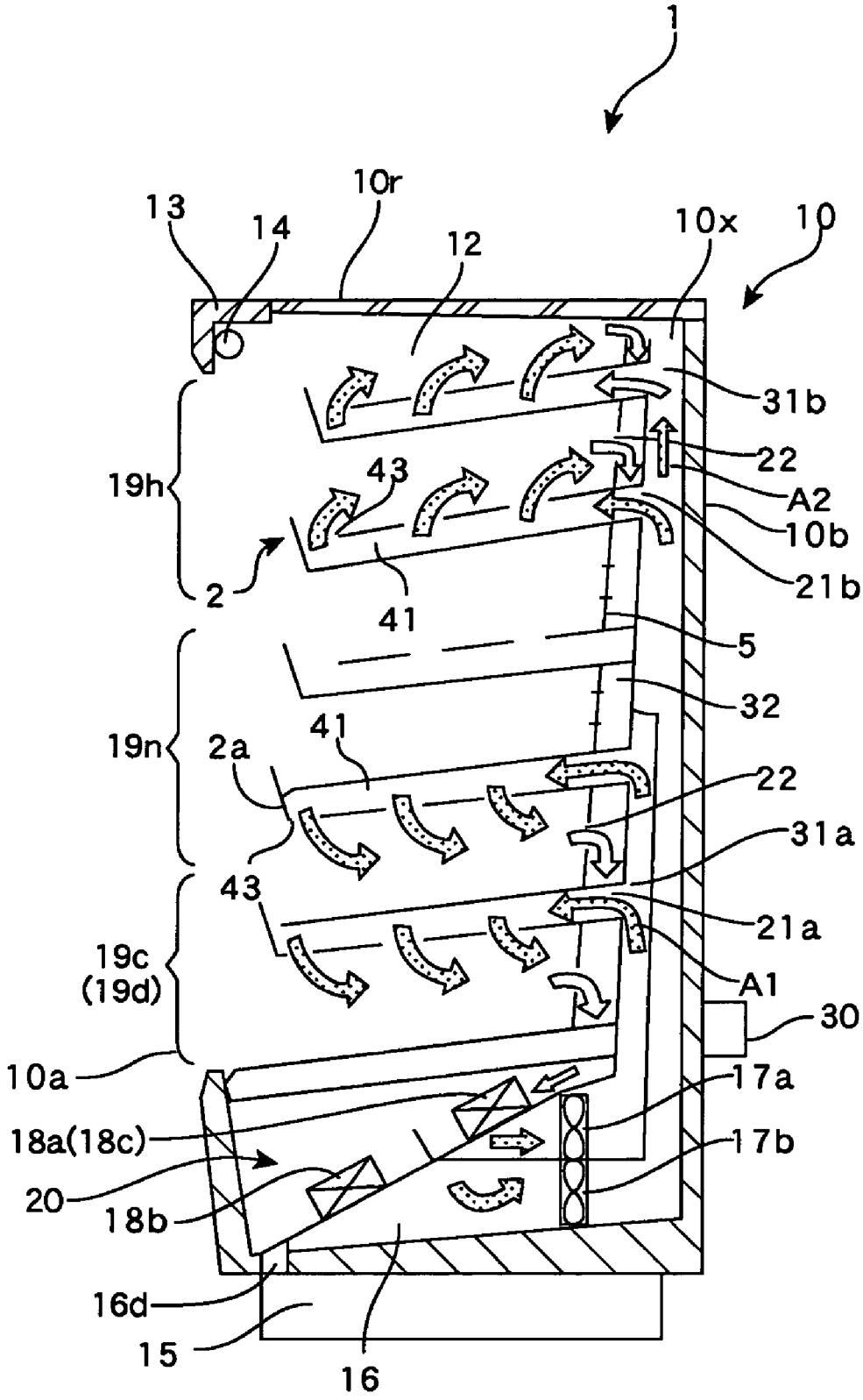
FIG. 9 is a view schematically showing a storage apparatus where a hot region, a normal temperature region and a cold region are provided inside the case.

FIG. 9 schematically shows yet another storage apparatus. This storage apparatus 1 is provided with a first supply duct 31*a* for sending a cold airflow A1 for chilling and a second supply duct 31*b* for sending a hot airflow A2 for heating. This storage apparatus 1 also includes, in the equipment space 16, a heat exchanger 18*a* for chilling and a feeding fan 17*a*, and a heat exchanger 18*b* for heating and another feeding fan 17*b*. In this storage apparatus 1, the control apparatus 30 drives a pair of the heat exchanger 18*a* for chilling and the fan 17*a* and a pair of the heat exchanger 18*b* for heating and the fan 17*b* so that the cold airflow A1 and the hot airflow A2 can be supplied to each zone 12. Exhaust air is sucked in, so that the temperature of each zone 12 is freely set. Accordingly, in addition to the heated region 19*h* and the room temperature region 19*n*, zones 12 whose temperature is controlled in a chilled region 19*c* can also be set in a single display space 11.

The conditioning air A supplied from the supply duct 31 can be humidified air or dried air for adjusting humidity, or other kinds of air. In FIG. 9, a humidifier 18*c* is disposed in place of the heat exchanger 18*a* for chilling, so that conditioning air A1 for adjusting humidity can be supplied via the first supply duct 31*a* and zones 12 whose humidity is controlled can be provided in the display case 10 so as to form a humid region or dry region 19*d*.

In a convenience store or the like, the storage apparatus 1 according to the present embodiment can store different products in different conditions in accordance with seasonal conditions and demand. Using this storage apparatus 1, without having to newly provide equipment such as a hot plate for heating, customers can compare and purchase chilled products, heated products, and products displayed at room temperature in an open display case 10 of the storage apparatus 1. Accordingly it is possible to make efficient use of space in a store and to provide customers with an environment in which it is easier to select items, so that customers enjoy trouble-free shopping.

In addition, as described above, with the storage apparatus 1 according to the present embodiment, products can be displayed at desired temperatures in an open-type showcase without providing an air curtain. Accordingly, since there is tens percentages increase in the number of products that can be displayed in a single storage apparatus 1, space inside the store is used even more efficiently, so that products is displayed with more free space, which makes shopping easier.

Figure 10:
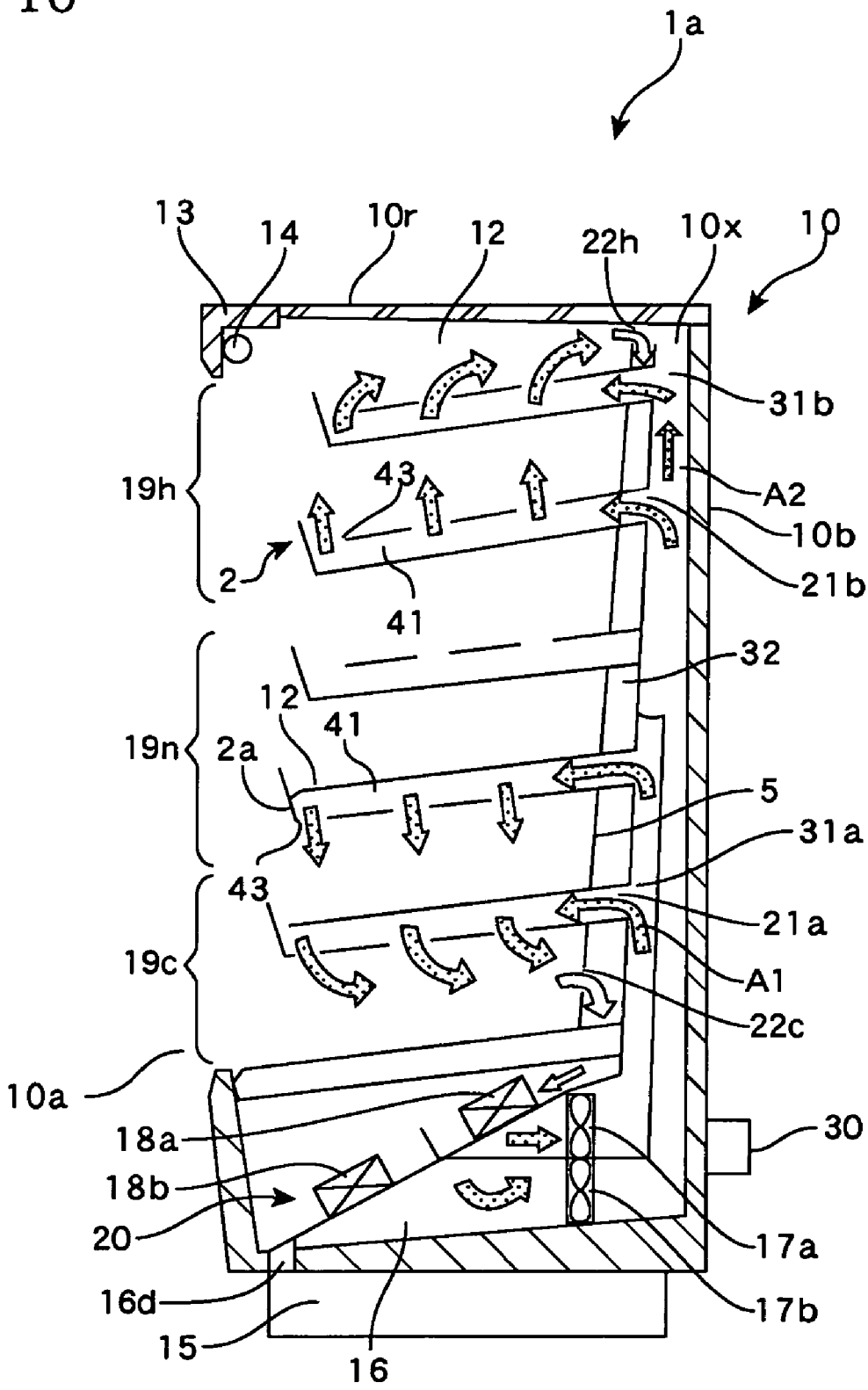
FIG. 10 is a view schematically showing a storage apparatus where one exhaust opening is disposed corresponding to a plurality of zones.

FIG. 10 shows yet another storage apparatus 1*a*. In this storage apparatus 1*a*, a common exhaust opening 22*h* is provided per two zones 12 in the heated region 19*h* at the top, while another common exhaust opening 22*c* is provided per two zones 12 in the chilled region 19*c* at the bottom. In the previous storage apparatuses, a construction where one exhaust opening 22 is provided per zone 12, that is a construction where there is one-to-one correspondence between the zones 12 and the exhaust openings 22 is used. The exhaust openings 22 may not need to correspond one-to-one with the zones 12, and in the storage apparatus 1*a*, the warm airflow A2 is sucked in via an exhaust opening 22*h* at the top while the cold airflow A1 is sucked in via an exhaust opening 22*c* at the bottom.

Figure 11:
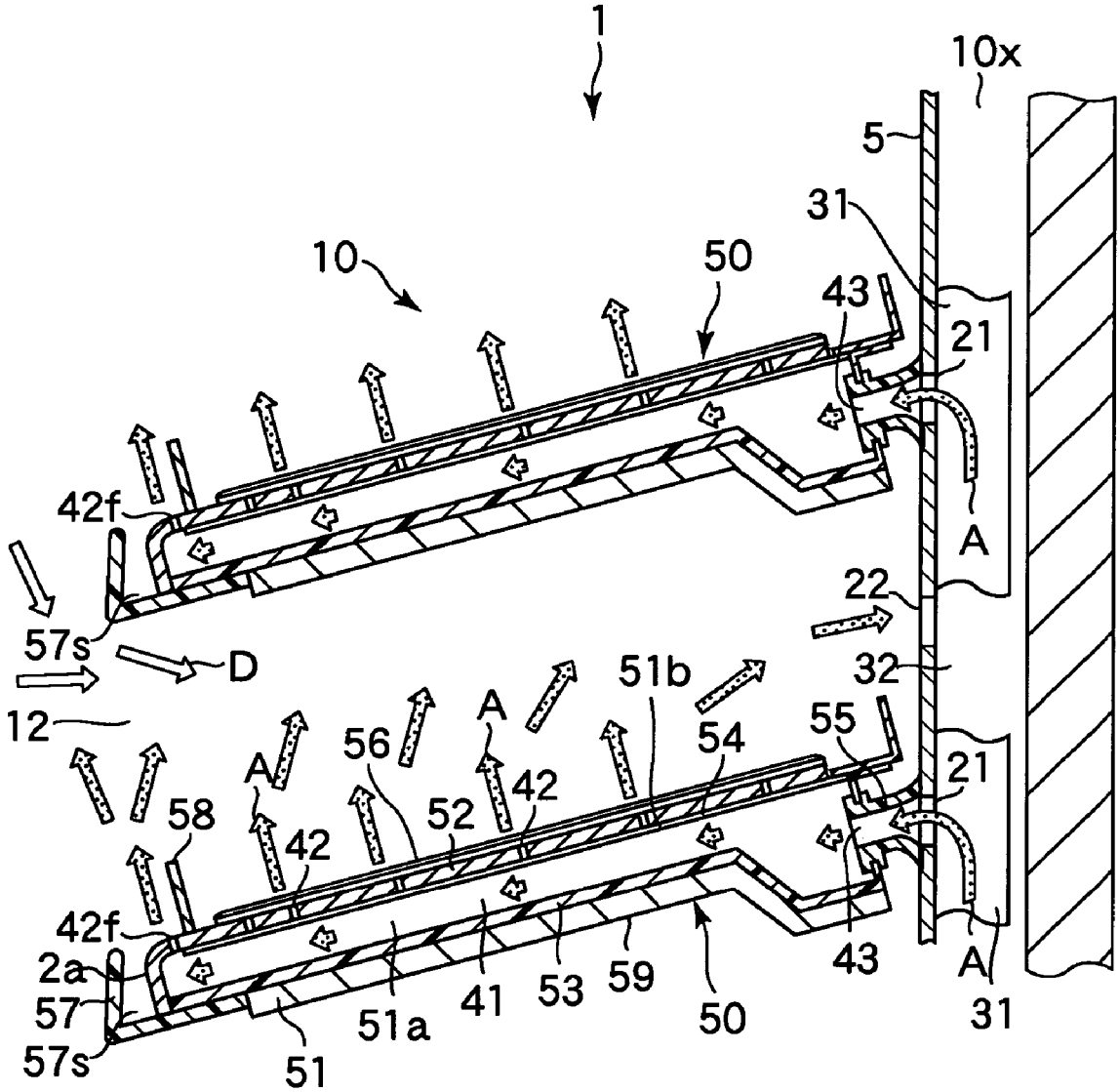
FIG. 11 is a cross-sectional view showing an enlargement of part of a storage apparatus to which different display shelves have been attached.
Figure 12A:
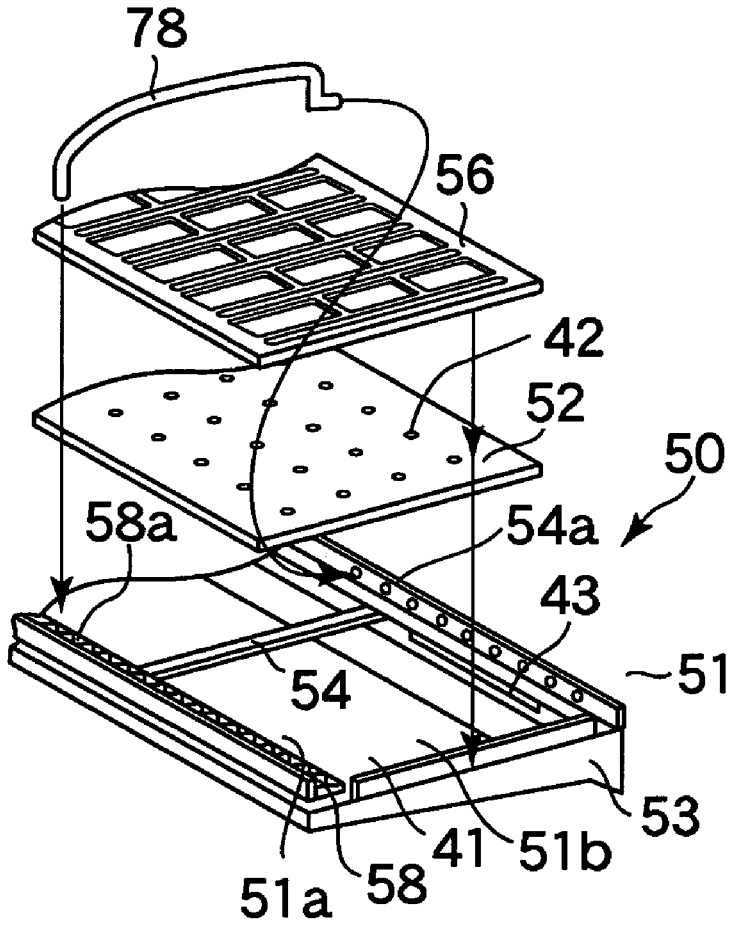
FIG. 12A is an exploded view showing a display shelf where shelf plates can be detachably attached to a shelf main body.

FIG. 11 is a cross-sectional view showing a different example of a display shelf. FIG. 12A is an exploded perspective view schematically showing the construction of a display shelf 50. The display shelf 50 of the present embodiment is provided with a shelf main body 51 and a plurality of shelf plates 52 made of stainless steel that are laid over the shelf main body 51. The space surrounded by the shelf main body 51 and the plurality of shelf plates 52 forms the internal duct 41 for supplying conditioning air. The shelf main body 51 is provided with a recessed part 51*a* whose upper part is an opening 51*b* and the internal duct 41 is formed by attaching the shelf plates 52 so as to cover this opening 51*b* in the upper part of the recessed part 51*a*. A plurality of blow holes 42 are formed in the shelf plates 52 and cold air (conditioning air) A supplied to the internal duct 41 is supplied to the zone 12 by the plurality of blow holes 42.

The shelf main body 51 of the present embodiment is formed of ABS resin or the like and has a duct plate 53 in the form of a plate whose inside is concave, and a plate metal frame 54 for holding the shelf plates 52 at a predetermined height is attached so as to cross the opening 51*b* in the upper part of the duct plate 53. The duct plate 53 is provided with a connecting opening 43 that can be connected to a supply opening 21. The connecting opening 43 is connected to the supply opening 21 via a grommet 55. A slatted-board-like or lattice-like plate 56 made of resin is placed on the shelf plates 52. By using a fluororesin with a low friction coefficient, as represented by DURACON (registered trademark), TEFLON (registered trademark) and the like, as the plate 56, it is possible to facilitate the sliding of canned drinks and the like on the display shelf. In addition, by laying the slatted-board-like plate 56 on the shelf plates 52, it is possible to provide a certain amount of distance between the shelf plates 52 and the displayed products so that the supplying of the conditioning air is not lost due to the blow holes 42 of the shelf plates 52 being covered by canned drinks and the like placed on display. This means that conditioning air can be reliably supplied from the blow holes 42 provided in the shelf plates 52 to the zone. A price tag holder 57 is attached to the front of the shelf main body 51, and a stopper 58 to prevent products from falling is provided at the front of the shelf plates 52. An insulating material 59 such as polyethylene or polystyrene foam is provided inside or outside (on the bottom side) of the duct plate 53. By doing so, condensation can be prevented on the rear side of the display shelf 50, so that water droplets can be prevented from falling onto the display shelf below.

Figure 12B:
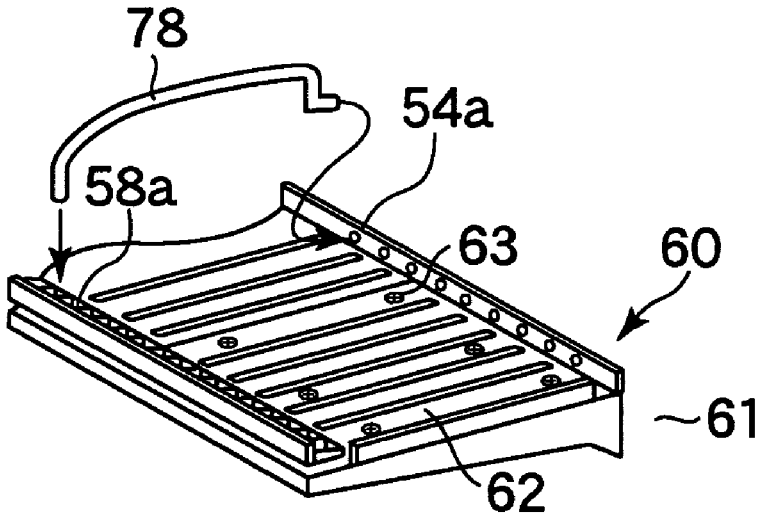
FIG. 12B is a view showing a display shelf where the shelf plates are screwed onto the shelf main body.

FIG. 12B shows an example of a display shelf 60 where shelf plates 62 are screwed onto a shelf main body 61. In FIG. 12A and FIG. 12B, members such as the insulating material 59, the grommet 55, and the price tag holder 57 are not shown. With the display shelf 60 shown in FIG. 12B, the shelf plates 62 are fixed to the shelf main body 61 by screws 63. Accordingly, when cleaning the display shelf 60, it is only possible to carry out a simple cleaning process where the surface of the shelf plates 62 is wiped with a cloth or the like. If the display shelf has no blow holes 42, cleaning the surfaces of the shelf plates is sufficient. However, if the shelf plates are provided with blow holes 42 and in particular with blow holes 42 that blow cold and other air upwards, when a liquid is spilt, the liquid will enter the inside of the display shelf via these blow holes 42. Also, after prolonged use, fine dust particles and other foreign matter may enter the display shelf and may become damp when cold air is supplied, which can cause odors and the like.

With a screwed-down display shelf 60 such as that shown in FIG. 12B, when cleaning the inside of the shelf, it is necessary to remove all of the screws 63 in order to remove the shelf plates 62 from the shelf main body 61. Accordingly, the process of cleaning the insides of the display shelf 60 of the showcase becomes extremely troublesome. On the other hand, with the display shelf 50 shown in FIG. 12A, the shelf plates 52 are merely placed on the shelf main body 51 and are not fixed with screws or the like. The shelf plates 52 are kept on the shelf main body 51 by their own weight. The shelf plates 52 can be freely put on and taken off the shelf main body 51. The slatted-like-plate 56 is simply disposed on the shelf plates 52. By using a construction where the shelf plates 52 and the slatted-plate 56 fall into the duct plate 53, it is possible to prevent the shelf plates 52 and the slatted-plate 56 from moving even in a state where the shelf plates 52 and the slatted-plate 56 are simply placed on top of one another. In addition, by inserting partition rods 78 or partition plates, which can appropriately divide up the region of the display shelf 50 above the slatted-plate 56, the partition rods 78 act as stoppers and so prevent the shelf plates 52 and the slatted-plate 56 from being unintentionally separated. This means that by simply removing the partition rods 78, the slatted-plate 56 and the shelf plates 52 can be easily removed from the shelf main body 51, and the duct plate 53, the slatted-plate 56, and the shelf plates 52 can be easily given a thorough washing. Since the internal duct 41 is exposed by this dismantling, it is also easy to clean the insides of the duct. This means that dirt, dust and moisture can be removed from inside the internal duct 41 extremely easily. Accordingly, maintenance is very easy for the display shelf 50 of the present embodiment that can be dismantled, so that the display shelf 50 is ideal for keeping the space for displaying products clean. A plurality of holes 54*a* and 58*a* into which the partition rods 78 can be inserted are provided in the metal plate frame 54 and the stopper 58, so that the partition rods 78 can be attached at freely chosen positions.

As shown in FIG. 11, by providing the blow holes (front blow holes) 42*f* that send out cold air at the front of the display shelf 50 and in particular in front of the part where the products are displayed, it is possible to send out the cold air A from in front of the products arranged on the display shelf 50, so that part of the cold air can be made to function as an air curtain that shuts the products out from the external air. However, together with the cold air A, it is possible for the external air D to be sucked along the rear surface or base surface of the upper display shelf 50 into the exhaust opening 22. When the vertical interval between the display shelves 50 is large, the external air D may be especially affective.

Figure 13A:
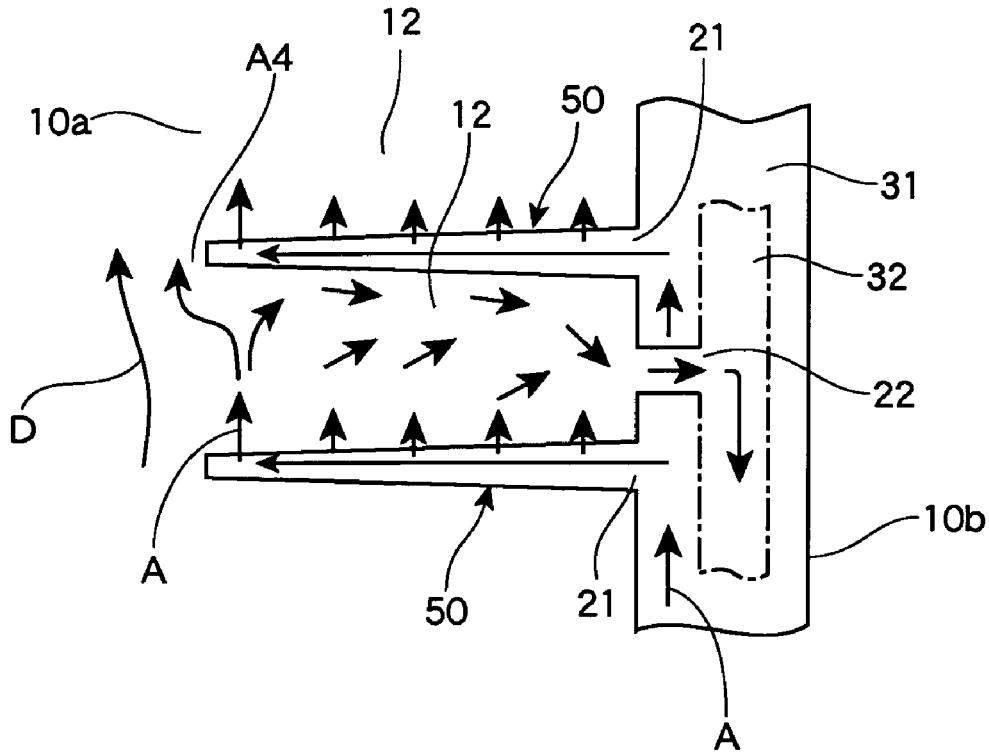
FIG. 13A is a view showing how part of the conditioning air sent out above the display shelves leaks to the outside.
Figure 13B:
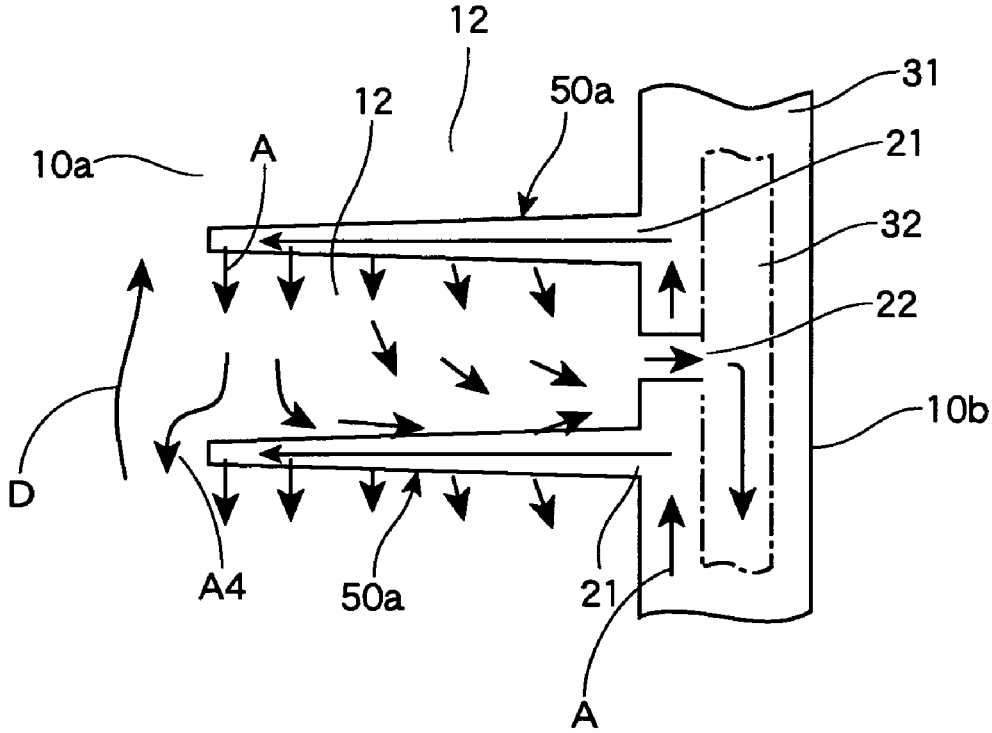
FIG. 13B is a view showing how part of the conditioning air sent out below the display shelves leaks to the outside.

In the storage apparatus 1, fresh air is taken in via the air duct 20 as described above and part of the cold air A sent out from the front blow holes 42*f* is allowed to leak out of the zone 12 to the outside. FIG. 13A shows how partial flow A4 of the cold air A leaks out to the outside. As shown in this drawing, the amount of cold air A supplied to the zones 12 is made larger than the amount of air that is sucked in to create a slightly pressurized state, and the partial flow A4 of the cold air A leaks out to the outside and blocks the external air D, so that the external air D does not penetrate the zones 12. FIG. 13A shows an "upflow-type" storage apparatus where the cold air A is blown upwards from the display shelves 50, but as shown in FIG. 13B, it is also possible with display shelves 50*a* that blow out the cold air A downwards to have part A4 of the cold air A leak out to the outside. Even when this kind of "downflow-type" is used, by having partial flow A4 of the cold air leak out from the zones 12 and block the external air D, the external air D can also be kept from penetrating the zones 12.

Figure 14:
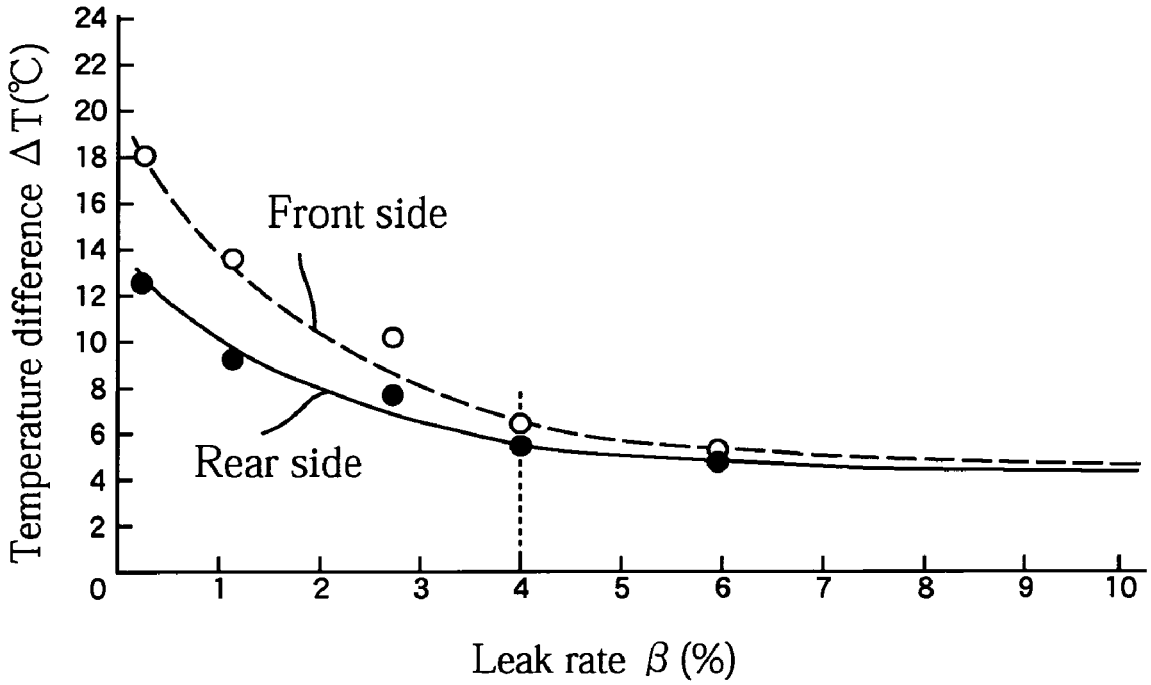
FIG. 14 is a graph showing the relationship between fluctuations in temperature inside a zone and the leak rate of the conditioning air.

If the proportion (expressed as a percentage) of the amount α of the conditioning air that leaks out to the outside to the amount V1 of conditioning air supplied to the zones 12 is set as a leak rate β, the relationship between (i) a temperature difference ΔT given by subtracting a lowest temperature from a highest temperature used as the fluctuation in temperature in the zones and (ii) the leak rate β is shown in FIG. 14. The curve shown by the broken line is the temperature difference ΔT in a region at the front (near the outside), and the curve shown by the solid line shows the temperature difference ΔT in a region at the back (near the exhaust openings 22). FIG. 14 shows the relationship when the external air temperature is 25° C., hot air is supplied to the zones 12, and the products are heated with the intended temperature being 58° C. As can be understood from this graph, as the leak rate β increases, there is a decrease in the fluctuation in temperature in both the region at the front and the region at the back. This is due to the penetration of the external air D being effectively prevented. When the leak rate β is around 4% or above, the fluctuation in temperature in both the region at the front and the region at the back is kept to around 6° C. or less, so that there is a very little fluctuation in temperature across the entire zones. When the leak rate β exceeds 4% there is little change in the fluctuation in temperature, and when the leak rate β exceeds 10% there is almost no change in the fluctuation in temperature. Increasing the leak rate β means the addition of fresh air, so that the load of the refrigeration apparatus 18*a* and the heater 18*b* set in the air duct 20 is increased. This means that increases in the leak rate p lead to increases in power consumption.

From these results, it is preferable for the leak rate p that is the difference between the supplied amount of conditioning air and air intake amount (i.e., the excess air supply rate) to be around 10% or below. To reduce the fluctuation in temperature while reducing the cooling or heating load to the greatest possible extent, the leak rate β should be around 5% or below, and more preferably 4% or below. Accordingly, in view of the load of heating/cooling the fresh air, it is preferable for the difference between the amount of air supplied to the respective zones and the air intake amount to be at the smaller end of the range given above. It is preferable to design the supply duct 31 and the exhaust duct 32 so that the supplied amount of air is approximately equal to the intake air (return air) amount and to set a minute difference between the supply air and the return air through the design of the blow holes and the intake holes. Accordingly, it is preferable to use a design where a draft loss at a supply opening is approximately equal to a draft loss at an exhaust opening corresponding to the supply opening, with the difference between them preferably being kept to within around ±5%. Compared to a downflow-type arrangement that is suited to chilling, more external air D may penetrate an upflow-type arrangement that is suited to heating, so that such arrangement sometimes is susceptible to differences in temperature across the entire zones. However, even in the upflow-type arrangement, as shown above, by setting the conditions of excess air supply rate at around 10% or below, it is possible to suppress fluctuations in temperature and the condition is applicable to a downflow-type. Also, the conditions that setting the excess supply rate at around 5% or below is preferable and setting the excess air supply rate at around 4% or below is more preferable are also applicable for the downflow-type. Accordingly, in both the upflow type and downflow type and during both chilling and heating, it is preferable to set the excess air supply rate at around 10% or below, it is more preferable to set the excess air supply rate at around 5% or below, and even more preferable to set the excess air supply rate at around 4% or below.

FIG. 15 shows an enlargement of the upper part of another storage apparatus 1*b*. Display shelves 70, which are provided with a plurality of blow holes (first front blow holes) 42*f* that face upwards and a plurality of blow holes (second front blow holes) 42*d* that face downwards are provided near the front end, are set in this storage apparatus 1*b*. By using these display shelves 70, it is possible to also supply cold air A1 downwards from the second front blow holes 42*d*. This means that in the respective zones 12 aside from the uppermost zone 12*u*, a more durable air curtain is formed at the front of the zone 12 by the cold air A1 supplied from the second front blow holes 42*d* of an upper display shelf 70 and the cold air A2 supplied from the first front blow holes 42*f* of a lower display shelf 70. This air curtain can reliably prevent the external air D from penetrating the zone 12. Even in cases where the zones 12 are considerably high and/or wide, by sending out the air A1 and A2 from above and below, it is possible to effectively suppress the penetration of the external air D. This means that it is possible to set the conditions of the zone 12 at the desired values in a short time and thereafter such conditions can be easily maintained. By preventing the penetration of the external air D, the amount of heat penetration can be reduced so that it is possible to reduce the amount of power that needs to be consumed to cause the temperature of the zone 12 to reach the desired temperature and thereafter maintain the desired conditions.

It is not possible to dispose a display shelf above the uppermost zone 12*u*. In the storage apparatus 1*b* of the present embodiment, roof blow holes 21*u* that blow out cold air A3 towards the front side 10*a* are provided in a periphery of the roof part 10*r* of the partition wall 5. In addition, a cosmetic plate 13, which is attached to the front of the roof part 10*r* so as to face downwards, extends forwards at an angle. Accordingly, the cold air A3 supplied to the uppermost zone 12*u* from the roof blow holes 21*u* is led downwards from an angle at the front with the cosmetic plate 13 at the front as a guide. Together with the cold air A2 supplied from the first front blow holes 42*f* of the display shelf 70, an air curtain is formed at the front of the zone 12*u*, so that in the same way as the zones 12 described above, the penetration of the external air D is also suppressed for the uppermost zone 12*u*. Accordingly, it is possible to make the temperature of the uppermost zone 12*u* reach a predetermined temperature in a short time and to maintain such condition using little energy. When a transparent roof part 10*r* is used, it is difficult to insulate the roof part 10*r* so that it becomes easy for external heat to penetrate through the roof. However, by supplying the cold air A3 along the roof part 10*r* and through the roof blow holes 21*u*, heat penetration through the roof can be reduced.

Figure 16A:
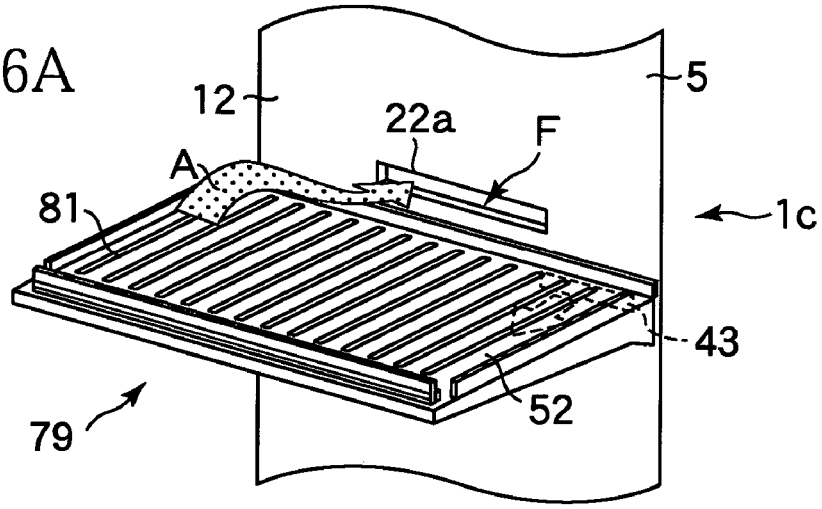
FIG. 16A is a view showing a storage apparatus that has an intake opening in a center in the width direction of the display shelves.
Figure 16B:
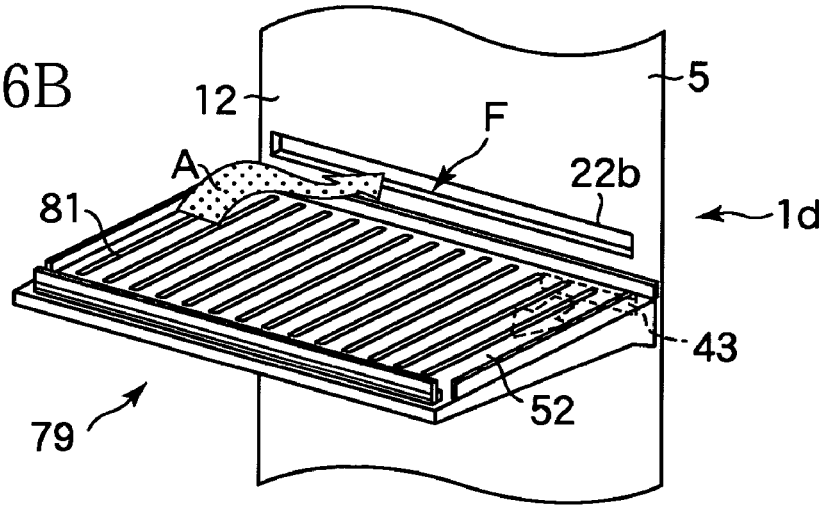
FIG. 16B is a view showing a storage apparatus in which an intake region with a width approximately equal to the display shelves is formed.
Figure 16C:
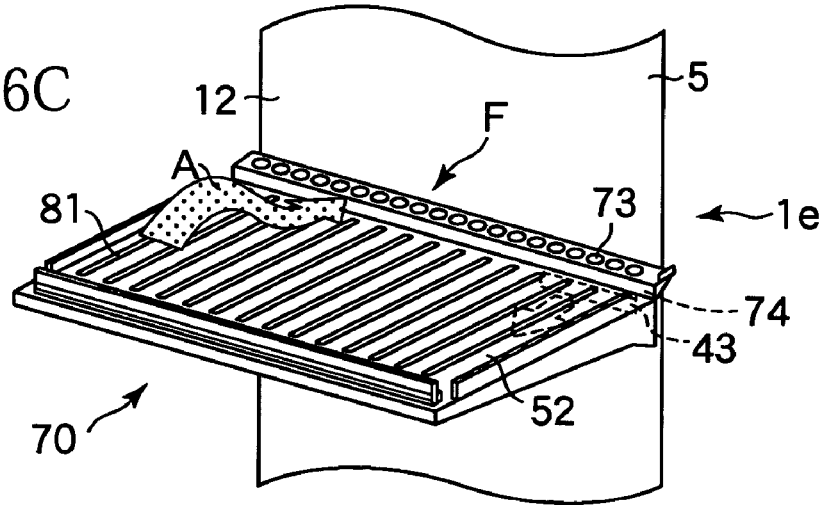
FIG. 16C is a view showing a storage apparatus in which a plurality of intake holes are formed.

Environmental conditions, such as the temperature, within a zone, are also influenced by the form or layout of the exhaust openings that are connected to the exhaust duct 32 and take in the cold air A of the zone 12. FIGS. 16A to 16C show a number of examples of these exhaust openings 22. It should be noted that although the blow holes 42 have been omitted from the display shelves 70 and 79 shown in these drawings, as described above, these display shelves are provided with blow holes that blow out conditioning air, such as cold air, upwards from the shelf plates 52. Ribs 81 for allowing products to slide are provided on the surface of the shelf plates 52. In the storage apparatus 1*c* shown in FIG. 16A, a slit-like exhaust opening 22*a* is provided in the horizontal direction (the width direction). The width of this exhaust opening 22*a* is shorter than the width of the display shelf 79 and the exhaust opening 22*a* is disposed in the center of the display shelf 79, so that conditioning air such as cold air or hot air outputted from the blow holes 42 of the display shelf 79 can be relatively uniformly taken in and circulated in a symmetrical state in the width direction.

The storage apparatus 1*d* shown in FIG. 16B is provided with a slit-like exhaust opening 22*b* that extends in the width direction of the display shelf with a width that is approximately equal to that of the display shelf 79. In this storage apparatus 1*d*, an air intake region F that has the same width as the width across which the blow holes 42 of the display shelf 79 are dispersed is provided, and in the range covered by this air intake region F, the cold air A flows approximately evenly inside the zone. Accordingly, it is possible to almost completely eradicate fluctuations in temperature inside the zone.

In a storage apparatus 1*e* shown in FIG. 16C, a plurality of round exhaust holes 73 are provided in an air intake region F that extends in the width direction of the display shelf 70 in place of a single slit-like exhaust opening 22*b*. The shape of these exhaust holes or opening 73 is not limited to circles, and the exhaust holes 73 may be rectangular, oval, or the like. In addition, in the storage apparatus 1*e*, the exhaust holes 73 are provided in the display shelf 70 so as to extend upwards in a part at which the display shelf 70 is connected to the partition wall 5. To do so, in addition to the internal duct 41 for supplying cold air supplied from the supply duct 31 to the blow holes 42 from the connecting opening 43, the display shelf 70 is provided with a duct 74 formed in the width direction of the shelf. This additional internal duct 74 for return air is connected to the exhaust duct 32 via the exhaust opening 22, so that the return air from the exhaust holes 73 is collected in the internal duct 74 and is returned to the exhaust duct 32. The construction of the internal duct 74 for the exhaust air is shown in detail in FIG. 15. The display shelf 70 includes a recessed part 74*a* for forming the internal duct 74 when the display shelf 70 is attached to the display case 10. When the shelf 70 is attached, the recessed part 74*a* is tightly closed onto the display case 10 by packing 74*b* and the internal duct 74 is formed.

On a display shelf provided with a mechanism for blowing out cold air, one important issue is the prevention of condensation. Such condensation or dew is not desirable since not only does it adversely affect appearance but also if droplets of condensation fall, products arranged in a lower zone or on a lower display shelf will unintentionally become wet. With the display shelf 50 shown in FIG. 11 and the display shelf 70 shown in FIG. 15, an insulating material 59 is attached to a base surface of the display shelf so that moisture is prevented from condensing on the rear surface of the display shelf 50 and dripping below. Also, the part of the display shelf 50 where condensation is likely to occur is the front end that is closest to the outside. In the display shelves 50 and 70, a space 57*s* is provided between the price tag holder 57 positioned at the front end and the internal duct 41 to form a two-layered construction that prevents condensation from occurring. According to such anti-dew-forming construction, the price tag holder 57 does not become wet with condensation, so that price tags do not become wet and change color.

In addition, in the display shelf 70 shown in FIG. 15, the stopper 71 for products also has a two-layered construction and is formed so that an air layer is provided inside. By such construction, condensation on the front surface of the stopper 71 can be reliably prevented. This condensation-preventing or anti-dew-forming construction is not limited to a two-layered construction with an air layer in between, and a construction to which an insulating material is attached may be used, as may an insulating construction that has a vacuum layer in between.

Figure 17A:
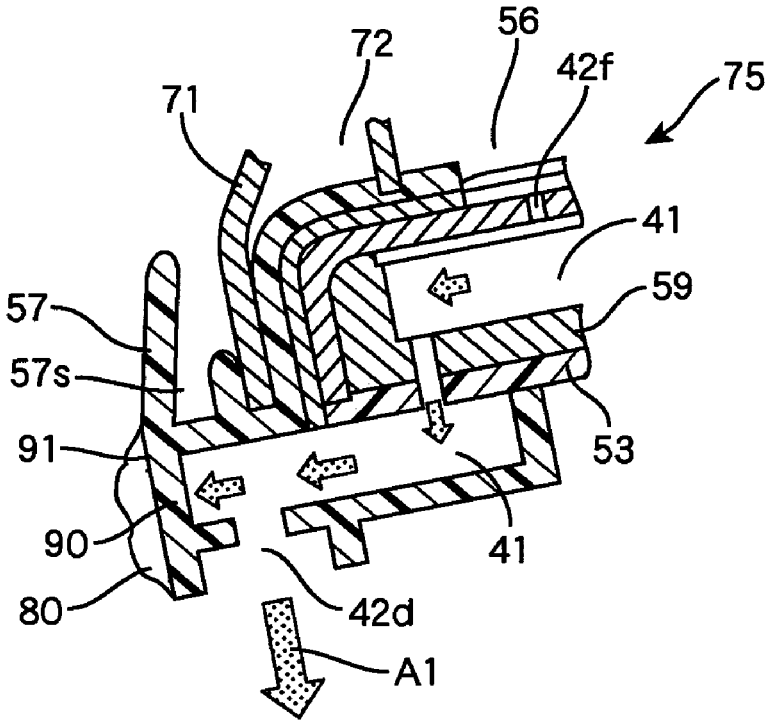
FIG. 17A is a cross-sectional view showing an enlargement of a front part of a different display shelf.
Figure 17B:
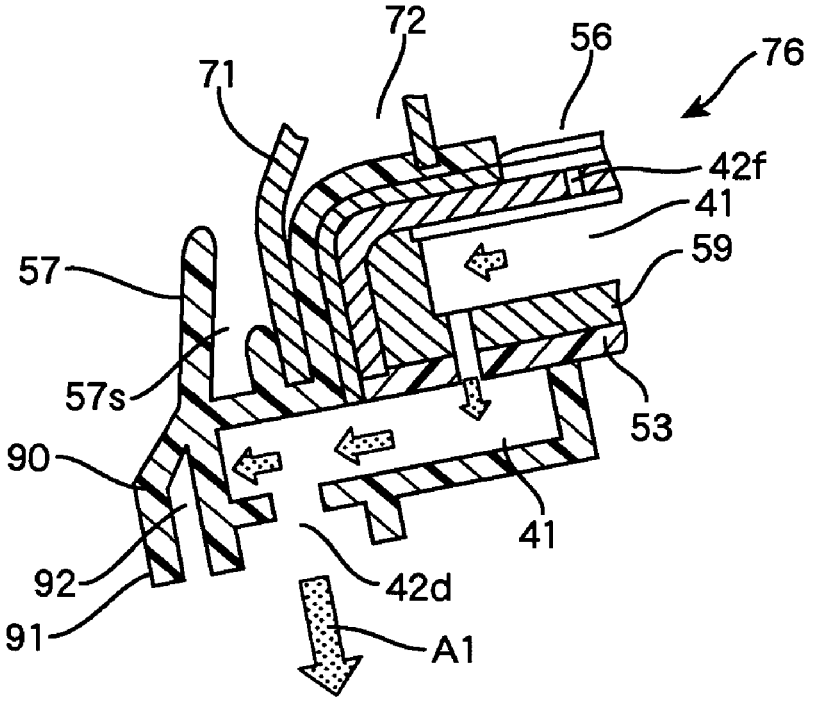
FIG. 17B is a cross-sectional view showing an enlargement of a front part of yet another different display shelf.

FIG. 17A shows a display shelf 75 in which second front blow holes 42*d* are also disposed on the front side. As described above, a stepped arrangement for the display shelves is used for making the products easy to see and easy to pick up. Accordingly, when the conditioning air such as cold air is blown out downwards from the display shelves to control the environment of the zones, it is preferable to arrange the blow holes as close as possible to the front. In the display shelf 75, the internal duct 41 extends below the price tag holder 57 and as far as the same position as the price tag holder 57 with the blow holes being formed below the internal duct 41. Accordingly, a surface 91 of a front part 90 below the price tag holder 57 may be susceptible to condensation 80. In the display shelf 76 shown in FIG. 17B, a two-layered construction is used where an air layer 92 comes in between the front part 90 and the internal duct 41. Accordingly, it becomes difficult for condensation to occur on the surface 91 of the front part 90, so that moisture can be prevented from dripping below.

Figure 18A:
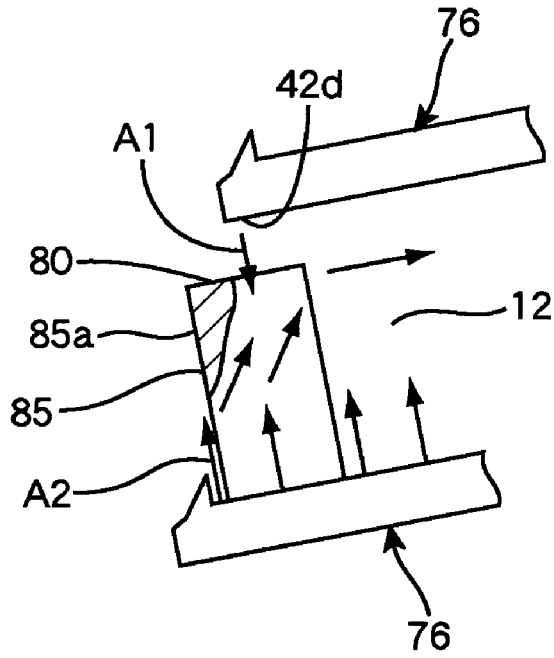
FIG. 18A is a view showing the flow of air when the conditioning air is blown out downwards from the front blow holes.

However, when the horizontal displacement between upper and lower display shelves is large, as shown in FIG. 18A even if cold air A1 is blown out from the front end of the display shelves 76, there is the possibility of parts of products 85 displayed at the front end of the lower display shelf 76 not being sufficiently covered with the cold air A1. As a result, condensation 80 occurs on parts 85*a* of the products 85, which may reduces the value of the product, results in the display shelf becoming wet, and may causes water droplets to drip.

Figure 18B:
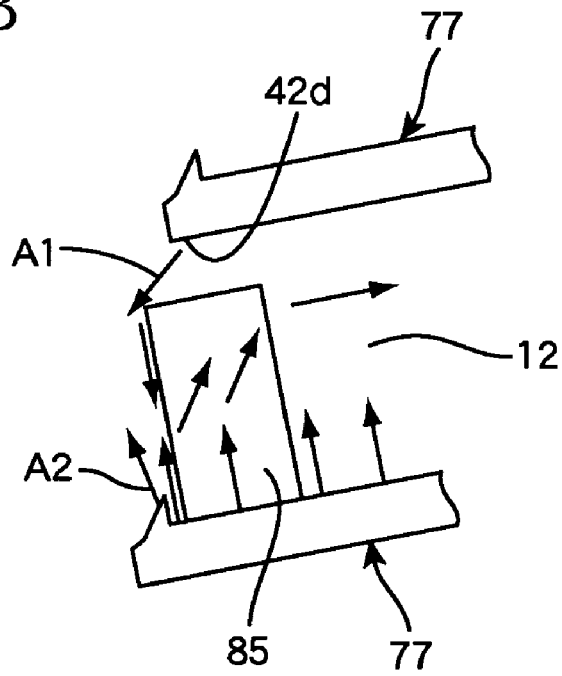
FIG. 18B is a view showing the flow of air when the conditioning air is blown out forwards at an angle from the front blow holes.

A display shelf 77 shown in FIG. 18B is designed so that the front blow holes 42*d* that blow out the cold air A1 downwards are angled towards the front and output the cold air forwards at an angle. Accordingly, even if the display shelves 77 are arranged in step-like, the products 85 arranged right at the front of lower display shelves can be entirely covered with the cold air A1, so that condensation is prevented from occurring.

Figure 19:
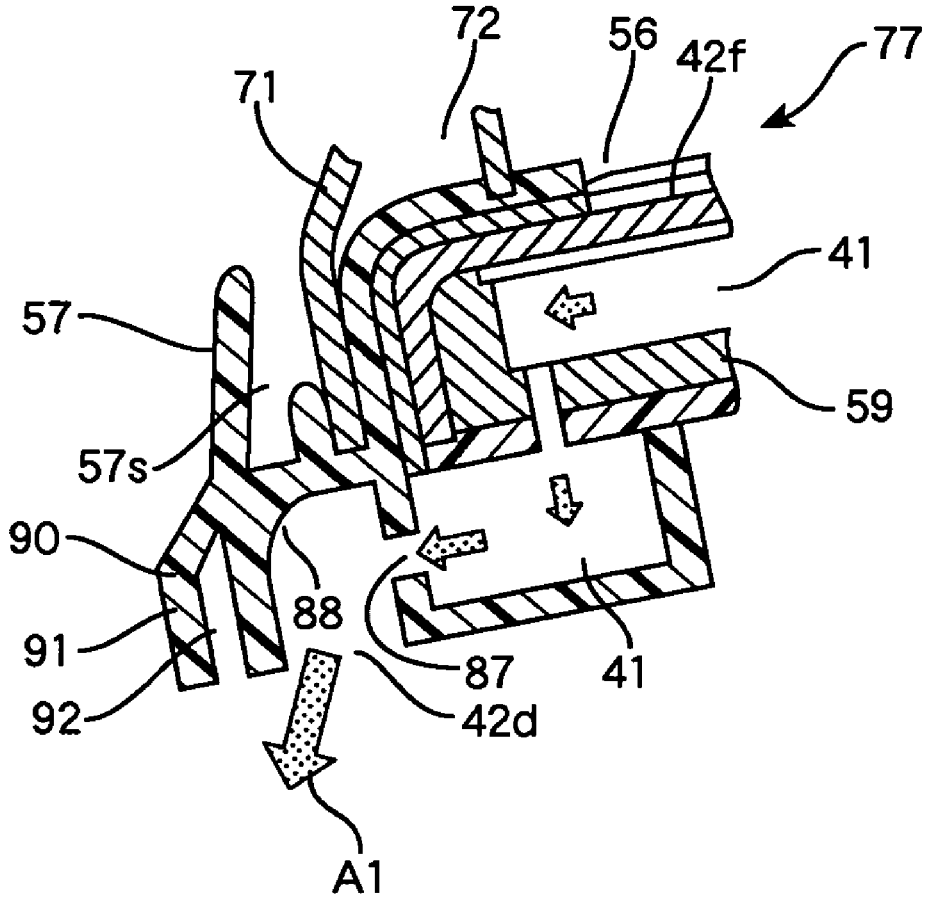
FIG. 19 is a cross-sectional view showing an enlargement of a front part of another different display shelf.

FIG. 19 is a cross-sectional view showing the construction of the front part of a display shelf 77 in more detail. The display shelf 77 is provided with blow holes 87 in front of the internal duct 41 that extends to the front end of the display shelf 77, with the cold air being supplied to the lower zone after the blowing direction of the cold air A1 has been changed to an angled forward direction by a wall part 88.

Although an example where the display space 11 that extends in the vertical or perpendicular direction is partitioned into zones 12 with the display shelves as separators has been described above, it is also possible to apply the present invention to a storage apparatus where zones are formed using partitions or walls that partition a display space that extends in a horizontal direction. In this case, the separators are the walls or partitions that partition the zones, and by providing small ducts corresponding to the internal ducts 41 described above inside or along these partitions, it is possible to efficiently heat or chill the zones.

In addition, the present invention can also be applied to a storage apparatus that is not an open-type apparatus, with it being possible to set environmental conditions such as an appropriate temperature in separate zone basis and to keep the products displayed in such zones at the desired conditions.

INDUSTRIAL APPLICABILITY

The storage apparatus according to the present invention circulates conditioning air for controlling the environmental conditions of zones in which products are stored in zone basis and can therefore keep the products in appropriate conditions without the apparatus having to be closed and without having to shut off the device from the outside using a large air curtain. Accordingly, by applying the present invention to an open-type showcase set up in a supermarket or a convenience store, it is possible to increase storage capacity. Also, since the storage conditions of products can be controlled in zone basis, it is possible to arrange chilled products, products at room temperature and also heated products inside a single showcase simultaneously, so that according to the present invention, it is possible to provide a new type of storage apparatus that can efficiently display a great variety of products.

The invention claimed is:

1. A storage apparatus comprising:

a display case part with a plurality of display shelves, a display shelf including a plurality of blow holes and a first internal duct to which the plurality of blow holes are connected, the plurality of blow holes being provided on a part for arranging products and being capable of blowing conditioning air upwards for controlling environmental conditions of the products;

a supply duct that is connected to supply openings for supplying the conditioning air to the plurality of display shelves;

an exhaust duct that is connected to at least one exhaust opening for taking in the conditioning air;

a first supply duct for chilling that is connected to a plurality of first supply openings for supplying cold air to the plurality of display shelves respectively; and a second supply duct for heating that is connected to a plurality of second supply openings for supplying hot air to the plurality of display shelves respectively.

2. A storage apparatus according to claim 1, further comprising:

a first supply damper that opens and closes a supply opening that is connected to the first supply duct; and a second supply damper that opens and closes a supply opening that is connected to the second supply duct, wherein the display shelf includes damper control means for being capable of opening and closing the first supply damper and the second supply damper for a corresponding display shelf when the display shelf is attached to the display case part.

3. A storage apparatus comprising:

a display case part with a plurality of display shelves, a display shelf including a plurality of blow holes and a first internal duct to which the plurality of blow holes are connected, the plurality of blow holes being provided on a part for arranging products and being capable of blowing conditioning air upwards for controlling environmental conditions of the products;

a supply duct that is connected to supply openings for supplying the conditioning air to the plurality of display shelves;

an exhaust duct that is connected to at least one exhaust opening for taking in the conditioning air;

an air duct that supplies air from the exhaust duct to the supply duct; and a refrigeration apparatus and a heating apparatus that are disposed inside the air duct.

4. A storage apparatus according to claim 3, further comprising switching means for switching operations of the refrigeration apparatus and the heating apparatus.

5. A storage apparatus according to claim 3, wherein the refrigeration apparatus and the heating apparatus are disposed in series so that the heating apparatus is downstream of the refrigeration apparatus.

6. A storage apparatus according to claim 3, further comprising a pressurizing fan that is disposed upstream of the heating apparatus in the air duct.

7. A storage apparatus comprising:

a display case part with a plurality of display shelves, a display shelf including a plurality of blow holes and a first internal duct to which the plurality of blow holes are connected, the plurality of blow holes being provided on a part for arranging products and being capable of blowing conditioning air upwards for controlling environmental conditions of the products;

a supply duct that is connected to supply openings for supplying the conditioning air to the plurality of display shelves;

an exhaust duct that is connected to at least one exhaust opening for taking in the conditioning air;

wherein the display shelf further includes first front blow holes that blow out the conditioning air upwards from a periphery of a front end of the display shelf and second front blow holes that blow out the conditioning air downwards from the periphery of the front end of the display shelf.

8. A storage apparatus comprising:

a display case part with a plurality of display shelves, a display shelf including a plurality of blow holes and a first internal duct to which the plurality of blow holes are connected, the plurality of blow holes being provided on a part for arranging products and being capable of blowing conditioning air upwards for controlling environmental conditions of the products:

a supply duct that is connected to supply openings for supplying the conditioning air to the plurality of display shelves;

an exhaust duct that is connected to at least one exhaust opening for taking in the conditioning air;

wherein the display shelf includes:

a shelf plate provided with a plurality of blow holes; and a shelf main body provided with a recessed part, upper part or lower part thereof being an opening to above or below so as to become the first internal duct, the shelf plate being detachably attached so as to cover the opening in the recessed part of the shelf main part.

9. A storage apparatus according to claim 8, wherein an insulating material is disposed inside the shelf main body.

10. A storage apparatus according to claim 8, wherein the shelf plate is made of stainless steel.

11. A storage apparatus according to claim 8, wherein the shelf plates are placed on the shelf main body.

12. A storage apparatus comprising:

a display case part with a plurality of display shelves, a display shelf including a plurality of blow holes and a first internal duct to which the plurality of blow holes are connected, the plurality of blow holes being provided on a part for arranging products and being capable of blowing conditioning air upwards for controlling environmental conditions of the products;

a supply duct that is connected to supply openings for supplying the conditioning air to the plurality of display shelves;

an exhaust duct that is connected to at least one exhaust opening for taking in the conditioning air:

wherein an uppermost layer of the part for arranging products of the display shelf is a slatted-board like member.

13. A storage apparatus according to claim 12, wherein the slatted-board like member is made of resin with a low friction coefficient.

* * * * *